US008331579B2

(12) United States Patent
Kato

(10) Patent No.: US 8,331,579 B2
(45) Date of Patent: Dec. 11, 2012

(54) REPRODUCING APPARATUS AND HEADPHONE APPARATUS

(75) Inventor: Tomonori Kato, Kanagawa (JP)

(73) Assignee: Sony Corporation, Tokyo (JP)

( * ) Notice: Subject to any disclaimer, the term of this patent is extended or adjusted under 35 U.S.C. 154(b) by 448 days.

(21) Appl. No.: 12/621,677

(22) Filed: Nov. 19, 2009

(65) Prior Publication Data

US 2010/0166208 A1 Jul. 1, 2010

(30) Foreign Application Priority Data

Dec. 26, 2008 (JP) ..... 2008-334942

(51) Int. Cl.

| | |
|---|---|
| ***H04R 1/10*** | (2006.01) |
| ***H04R 5/02*** | (2006.01) |
| ***H04R 1/02*** | (2006.01) |
| ***H04R 9/06*** | (2006.01) |
| ***H04R 25/00*** | (2006.01) |

(52) U.S. Cl. ..... 381/74; 381/309; 381/334; 381/383

(58) Field of Classification Search ..... 381/74, 381/334, 309, 311, 371, 383; 700/94
See application file for complete search history.

(56) References Cited

U.S. PATENT DOCUMENTS

| | | | | |
|---|---|---|---|---|
| 2005/0004690 | A1* | 1/2005 | Zhang et al. | 700/94 |
| 2005/0217459 | A1* | 10/2005 | Murakoshi | 84/600 |
| 2006/0250377 | A1* | 11/2006 | Zadesky et al. | 345/173 |
| 2008/0130910 | A1* | 6/2008 | Jobling et al. | 381/74 |
| 2008/0273737 | A1 | 11/2008 | Oosato et al. | |

FOREIGN PATENT DOCUMENTS

| | | | |
|---|---|---|---|
| JP | 10-66180 | A | 3/1998 |
| JP | 2001-57695 | A | 2/2001 |
| JP | 2005-202319 | A | 7/2005 |
| JP | 2005-328118 | A | 11/2005 |
| JP | 2006-323920 | A | 11/2006 |
| JP | 2008-227966 | | 9/2008 |

* cited by examiner

*Primary Examiner* — Vivian Chin
*Assistant Examiner* — Douglas Suthers
(74) *Attorney, Agent, or Firm* — Oblon, Spivak, McClelland, Maier & Neustadt, L.L.P.

(57) ABSTRACT

Disclosed herein is a reproducing apparatus including: a case; a headphone configured to be so provided as to protrude on one surface of the case and be inserted into an ear hole; an operating unit configured to be provided on a further surface orthogonal to the one surface of the case and near a base of the headphone and allow press-down operation and rotational operation; a reproducing unit configured to reproduce audio data; and a controller configured to be incorporated in the case and make the reproducing unit reproduce audio data stored in a storage medium based on operation input to the operating unit.

16 Claims, 23 Drawing Sheets

S1

PW1

PW2

S2B no S3 no D1

REPRODUCING APPARATUS AND HEADPHONE APPARATUS

BACKGROUND OF THE INVENTION

1. Field of the Invention

The present invention relates to a reproducing apparatus and a headphone apparatus, and is suitable for being applied to e.g. a reproducing apparatus and a headphone apparatus having an operating unit.

2. Description of the Related Art

Currently, there are various types of headphone apparatus different in the wearing method. For example, the following types are widely spread: a type covering the ear (around-ear type); a type carried on the ear (on-ear type); and a type inserted into the ear hole (inner-ear type or canal type).

Furthermore, there has also been proposed a headphone apparatus that has a protrusion part serving as both a part inserted into the ear hole and a part outputting sound at a predetermined position on a housing serving as a part carried on the ear, to thereby have features of the on-ear type and features of the canal type (refer to e.g. Japanese Patent Laid-open No. 2008-227966).

Moreover, in recent years, a wireless headphone apparatus including a wireless module has also been proposed in step with size reduction of the wireless module. This wireless headphone apparatus is wirelessly connected to a reproducing apparatus, and receives and reproduces audio data transmitted as radio waves from this reproducing apparatus.

Furthermore, an operating unit is provided in this wireless headphone apparatus and this operating unit allows remote operation of the reproducing apparatus from the wireless headphone apparatus side.

On the other hand, in step with size reduction of the reproducing apparatus itself, a reproducing apparatus integrated with a headphone apparatus (it will be referred to also as a headphone-integrated reproducing apparatus) has also been proposed.

SUMMARY OF THE INVENTION

In the case of the above-described wireless headphone apparatus and headphone-integrated reproducing apparatus, the operating unit such as buttons is located near the user's ear when the apparatus is mounted around the head. Therefore, the user can not operate the operating unit while viewing the operating unit but must operate the operating unit by fumbling about it.

In practice, plural buttons such as a reproduction start/stop button, a track forwarding button, and a track backing button are provided as the operating unit in the related-art wireless headphone apparatus and headphone-integrated reproducing apparatus. It is difficult to operate these plural buttons by fumbling about them.

Furthermore, in the case of such wireless headphone apparatus and headphone-integrated reproducing apparatus, as a result of force application to the operating unit by the user in attempt to operate the operating unit, the mounting position is shifted and the operating unit can not be successfully operated in some cases. Thus, the operability of the apparatus is not necessarily high.

There is a need for the present invention to propose a reproducing apparatus and a headphone apparatus having further-enhanced operability compared with related arts.

According to an embodiment of the present invention, there is provided a reproducing apparatus including a case, a headphone configured to be so provided as to protrude on one surface of the case and be inserted into an ear hole, an operating unit configured to be provided on a further surface orthogonal to the one surface of the case and near the base of the headphone and allow press-down operation and rotational operation, a reproducing unit configured to reproduce audio data, and a controller configured to be incorporated in the case and make the reproducing unit reproduce audio data stored in a storage medium based on operation input to the operating unit.

Due to this configuration, while the case is mounted around the head of the user through insertion of the headphone into an ear hole and other surfaces of the case are sandwiched by fingers so that the shift of this mounting position may be prevented, plural commands can be input through operation of the operating unit by any of the fingers sandwiching the case.

According to the embodiment of the present invention, while the case is mounted around the head of the user through insertion of the headphone into an ear hole and other surfaces of the case are sandwiched by fingers so that the shift of this mounting position may be prevented, plural commands can be input through operation of the operating unit by any of the fingers sandwiching the case. Thus, a reproducing apparatus and a headphone apparatus having further-enhanced operability compared with related arts can be realized.

DETAILED DESCRIPTION OF THE PREFERRED EMBODIMENTS

Best modes for carrying out the invention (hereinafter, they will be referred to also as embodiments) will be described below with reference to the drawings. The description will be made in the following order.

1. Embodiment
2. Other Embodiments

<1. Embodiment>

[1-1 Appearance Configuration of Headphone-Integrated Reproducing Apparatus]

Figure 1A:
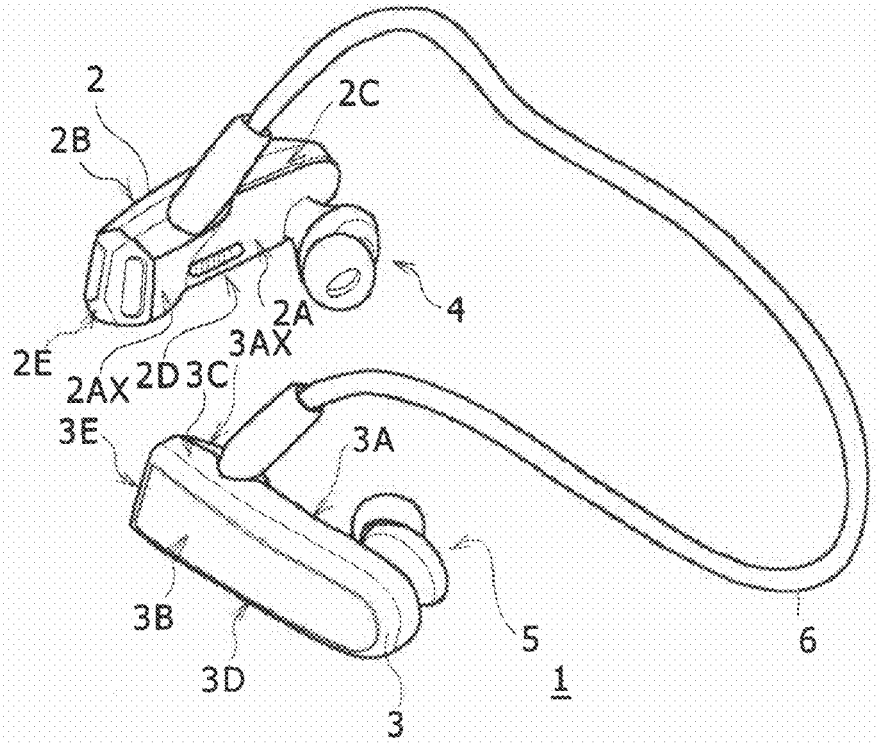
FIGS. 1A and 1B are schematic perspective views showing the appearance configuration of a headphone-integrated reproducing apparatus according to one embodiment of the present invention.
Figure 1B:
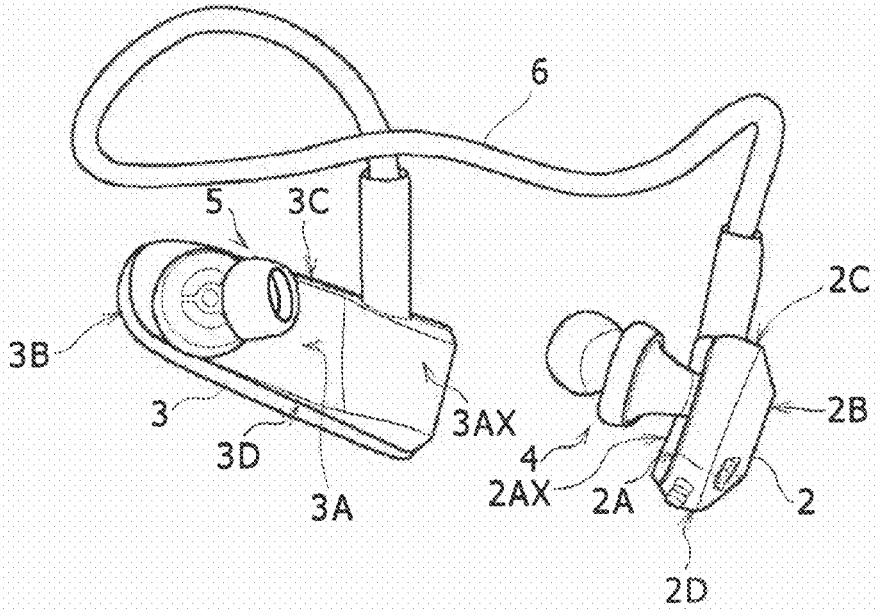

In FIGS. 1A and 1B, numeral 1 totally shows the appearance configuration of a headphone-integrated reproducing apparatus to which an embodiment of the present invention is applied. This headphone-integrated reproducing apparatus 1 has two cases 2 and 3 each formed of a long box having a substantially-bow shape.

In this case, in order that one end part of each of two cases 2 and 3 in the case longitudinal direction can be thicker than the other end part, raised step parts 2AX and 3AX are formed at the one end part on one surface 2A and one surface 3A.

In the headphone-integrated reproducing apparatus 1, one headphone for the right channel (hereinafter, it will be referred to also as the right headphone) 4, of a pair of stereo headphones of the canal type, is so provided as to protrude at the other end part of one surface 2A of one case 2.

Furthermore, in the headphone-integrated reproducing apparatus 1, the other headphone for the left channel (hereinafter, it will be referred to also as the left headphone) 5, of the pair of stereo headphones of the canal type, is so provided as to protrude at the other end part of one surface 3A of the other case 3.

Moreover, in the headphone-integrated reproducing apparatus 1, these one and the other cases 2 and 3 are connected to each other via a headband 6.

This headphone-integrated reproducing apparatus 1 is so configured as to reproduce, as audio data, audio data of music (hereinafter, it will be referred to also as music data particularly) and audio data of audio guides and sound effects (hereinafter, it will be referred to also as guide data particularly).

In the following description, one case 2 provided with the right headphone 4 will be referred to also as the right case 2, and the other case 3 provided with the left headphone 5 will be referred to also as the left case 3.

In addition, in the following description, one surface 2A of the right case 2, on which the right headphone 4 is provided, will be referred to also as the right case inside surface 2A, and the other surface 2B that is located on the opposite side to the right case inside surface 2A and has a bow shape will be referred to also as the right case outside surface 2B.

In addition, in the following description, of a pair of side surfaces 2C and 2D in contact with the right case inside surface 2A and the right case outside surface 2B in the right case 2, one side surface 2C will be referred to also as the right case upper surface 2C and the other side surface 2D will be referred to also as the right case lower surface 2D. Moreover, in the following description, one end surface 2E of the right case 2 will be referred to also as the right case one-end surface 2E.

Furthermore, in the following description, one surface 3A of the left case 3, on which the left headphone 5 is provided, will be referred to also as the left case inside surface 3A, and the other surface 3B that is located on the opposite side to the left case inside surface 3A and has a bow shape will be referred to also as the left case outside surface 3B.

In addition, in the following description, of a pair of side surfaces 3C and 3D in contact with the left case inside surface 3A and the left case outside surface 3B in the left case 3, one side surface 3C will be referred to also as the left case upper surface 3C and the other side surface 3D will be referred to also as the left case lower surface 3D. Moreover, in the following description, one end surface 3E of the left case 3 will be referred to also as the left case one-end surface 3E.

Figure 2:
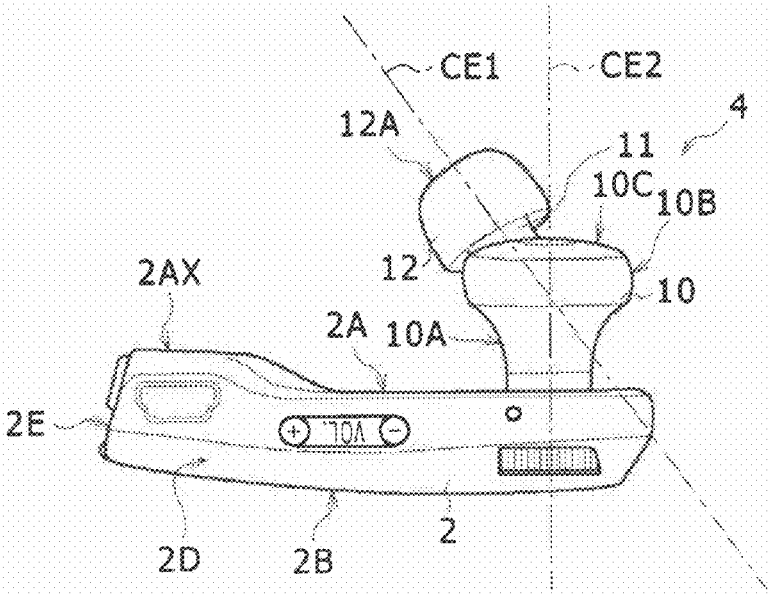
FIG. 2 is a schematic diagram showing the configuration of a right headphone.

As actually shown in FIGS. 1A, 1B, and 2, the right headphone 4 has a cylindrical driver housing 10 whose tip part 10B has a diameter larger than that of its base part 10A.

The base part 10A of the driver housing 10 is bonded to the other end part of the right case inside surface 2A in such a state that the center axis of the driver housing 10 is in parallel to the case thickness direction perpendicular to the right case inside surface 2A of the right case 2, and the driver housing 10 is so provided as to protrude from the other end part of the right case inside surface 2A.

On a circular tip surface 100 of the driver housing 10, a cylindrical sound introducing tube 11 is provided at a predetermined position closer to one end in the case longitudinal direction in such a way that the center axis CE1 of the sound introducing tube 11 is slightly inclined from the line in parallel to the center axis CE2 of the driver housing 10 toward the one end side in the case longitudinal direction.

The sound introducing tube 11 is inserted into a hole penetrating the center of an earpiece 12 formed by providing an umbrella-shape ear canal insertion part 12A at one end of a cylindrical attachment part by use of a resin material such as silicone rubber (the sound introducing tube 11 is inserted into a hole penetrating from the inside of the attachment part to the tip of the ear canal insertion part 12A).

That is, the earpiece 12 is attached to the sound introducing tube 11 in such a way that the tip part of the sound introducing tube 11 is exposed from the aperture at the tip of the ear canal insertion part 12A.

In the right headphone 4, a diaphragm and a headphone driver (not shown) having a drive circuit for the diaphragm and so on are housed in the driver housing 10.

This allows the right headphone 4 to transmit audio, such as music, generated by the headphone driver from the inside of the driver housing 10 through the inside of the sound introducing tube 11 and output it from the tip of the sound introducing tube 11 to the outside.

Figure 3:
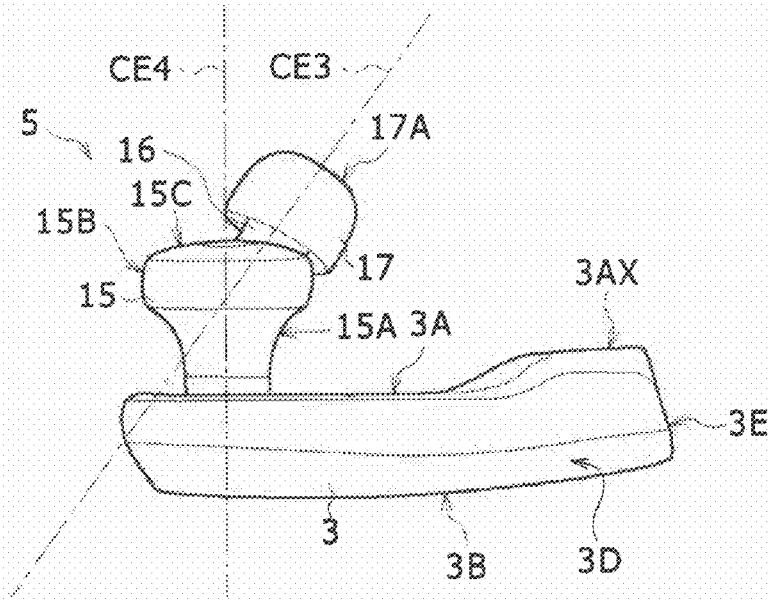
FIG. 3 is a schematic diagram showing the configuration of a left headphone.

On the other hand, as shown in FIGS. 1A, 1B, and 3, the left headphone 5 is configured similarly to the right headphone 4 basically.

Therefore, in the left headphone 5, a base part 15A of a driver housing 15, having a diameter smaller than that of a tip part 15B, is bonded to the other end part of the left case inside surface 3A in such a state that the center axis of the driver housing 15 is in parallel to the case thickness direction perpendicular to the left case inside surface 3A of the left case 3.

That is, also in the left headphone 5, the driver housing 15 is so provided for the left case 3 as to protrude from the other end part of the left case inside surface 3A.

On a circular tip surface 15C of the driver housing 15, a cylindrical sound introducing tube 16 is provided at a predetermined position closer to one end in the case longitudinal direction in such a way that the center axis CE3 of the sound introducing tube 16 is slightly inclined from the line in parallel to the center axis CE4 of the driver housing 15 toward the one end side in the case longitudinal direction.

An earpiece 17 having the same configuration as that of the above-described earpiece 12 is attached to the sound introducing tube 16 via a hole part, and the tip part of the sound introducing tube 16 is exposed from the aperture at the tip of an ear canal insertion part 17A of the earpiece 17.

In the left headphone 5, a diaphragm and a headphone driver (not shown) having a drive circuit for the diaphragm and so on are housed in the driver housing 15, similarly to the right headphone 4.

This also allows the left headphone 5 to transmit audio, such as music, generated by the headphone driver from the inside of the driver housing 15 through the inside of the sound introducing tube 16 and output it from the tip of the sound introducing tube 16 to the outside.

Inside the right case 2, a circuit board on which various circuit elements such as a central processing unit (CPU) and a read only memory (ROM) to be described later are mounted is housed. This circuit board is electrically connected to the headphone driver for the right headphone 4.

Inside the left case 3, a battery (not shown) capable of supplying power for driving the headphone-integrated reproducing apparatus 1 is housed.

Figure 4:
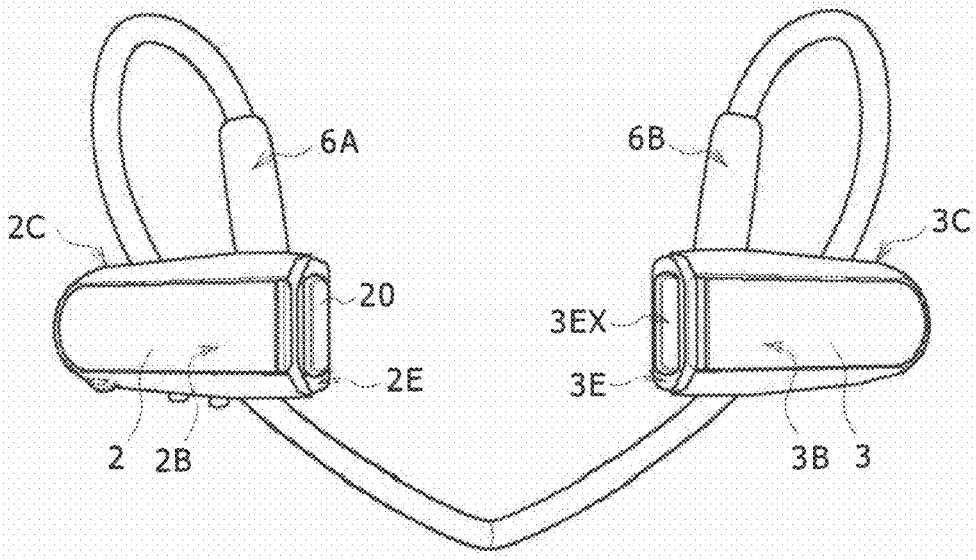
FIG. 4 is a schematic diagram showing the configuration of a headband and one end surface of each of a right case and a left case.

As shown in FIGS. 1A, 1B, and 4, one end of the headband 6 is connected to one end side of the right case upper surface 2C of the right case 2, and the other end thereof is connected to one end side of the left case upper surface 3C of the left case 3.

The headband 6 is formed of plural electrically-conductive lines covered by a coat composed of an insulating resin with elasticity. These conductive lines electrically connect the circuit board inside the right case 2 to the battery inside the left case 3 and the headphone driver for the left headphone 5.

The coat at one end part and the other end part of the headband 6 is further covered by protective tubes 6A and 6B composed of an insulating resin.

Thus, even when such external force as to bend one end part and the other end part of the headband 6 is applied to one end part and the other end part at the time of wearing/removing of the headphone-integrated reproducing apparatus 1, the protective tubes 6A and 6B prevent one end part and the other end part from being bent.

Thus, even when such external force as to bend one end part and the other end part of the headband 6 is applied to one end part and the other end part at the time of wearing/removing of the headphone-integrated reproducing apparatus 1, the occurrence of a crack in the coat and the disconnection of the conductive line at one end part and the other end part are prevented.

An adsorption plate 20 formed of a metal plate that adsorbs to a magnet is disposed on the right case one-end surface 2E of the right case 2.

At the center part of the left case one-end surface 3E of the left case 3, an adsorption plate housing 3EX formed of a recess having the shape, size, and depth matched with the shape, size, and thickness of the adsorption plate 20 is formed.

For the left case 3, a magnet to be described later is provided on the back side of the bottom plate of the adsorption plate housing 3EX (i.e. inside the left case 3).

Therefore, in the headphone-integrated reproducing apparatus 1, when the right case one-end surface 2E of the right case 2 and the left case one-end surface 3E of the left case 3 are brought close to each other with the right case inside surface 2A and the left case inside surface 3A oriented toward the same direction, the adsorption plate 20 is adsorbed by the magnet with the intermediary of the bottom plate in the adsorption plate housing 3EX.

Figure 5A:
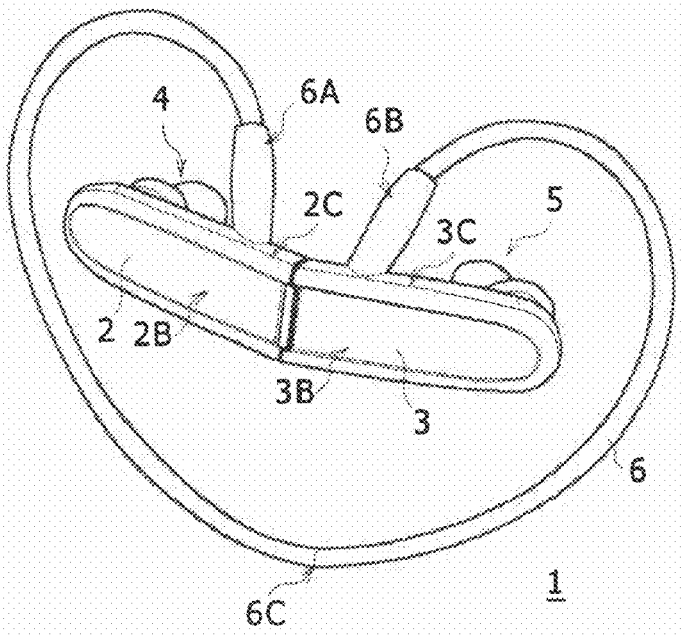
FIGS. 5A and 5B are schematic perspective views for explaining connection of the right case and the left case.
Figure 5B:
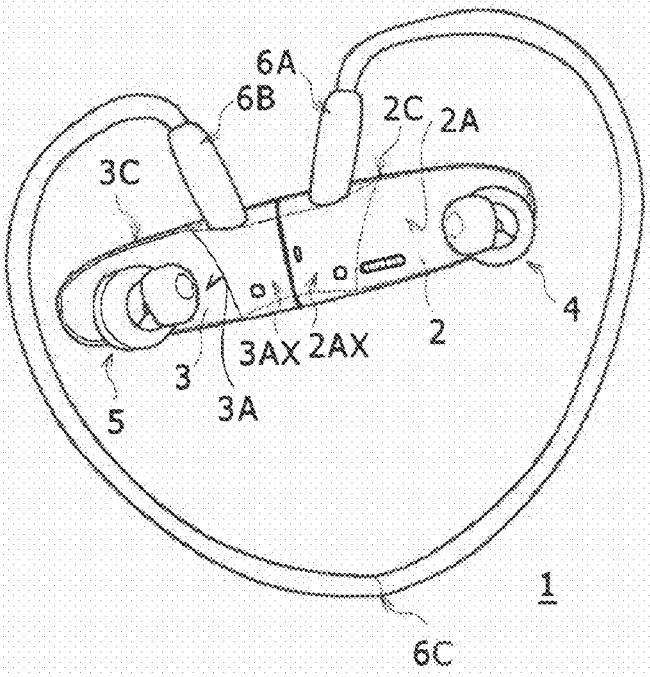

Thus, as shown in FIGS. 5A and 5B, when the headphone-integrated reproducing apparatus 1 is not mounted, the right case 2 and the left case 3 can be brought together compactly by connecting the right case one-end surface 2E to the left case one-end surface 3E with the right case inside surface 2A and the left case inside surface 3A oriented toward the same direction.

In the headband 6, a bent part 6C formed of a fold having a dogleg shape is formed in advance at almost the center position that divides the entire headband 6 into halves.

The headband 6 is so shaped that, when the right case 2 and the left case 3 are connected to each other, one end side and the other end side of the headband 6 are bent in an arc shape and make, together with the bent part 6C, a substantially-heart shape smaller than the human face as a whole around the connected right case 2 and left case 3.

Figure 6:
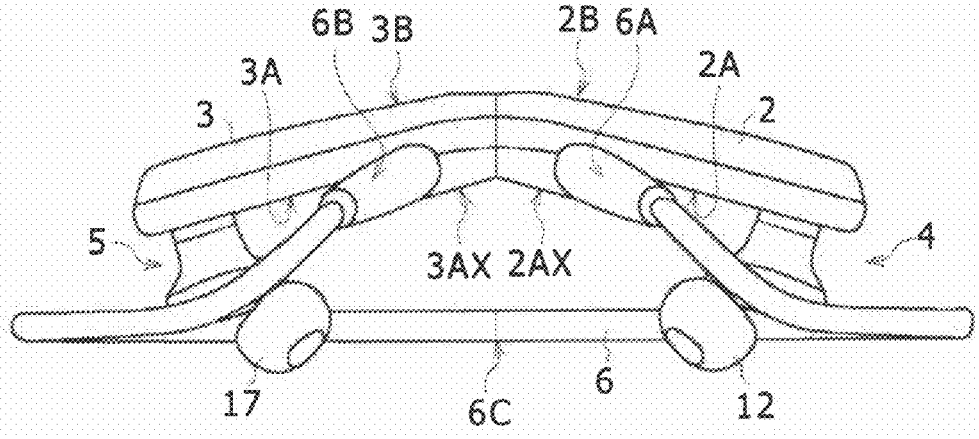
FIG. 6 is a schematic diagram showing the configuration of the headband when the right case and the left case are connected to each other.

Furthermore, as shown in FIG. 6, the headband 6 is also so shaped that, when the right case 2 and the left case 3 are connected to each other in this manner, the center part of the headband 6 between one end part and the other end part is located on the same virtual plane on the side toward which the right case inside surface 2A and the left case inside surface 3A are oriented.

Figure 7:
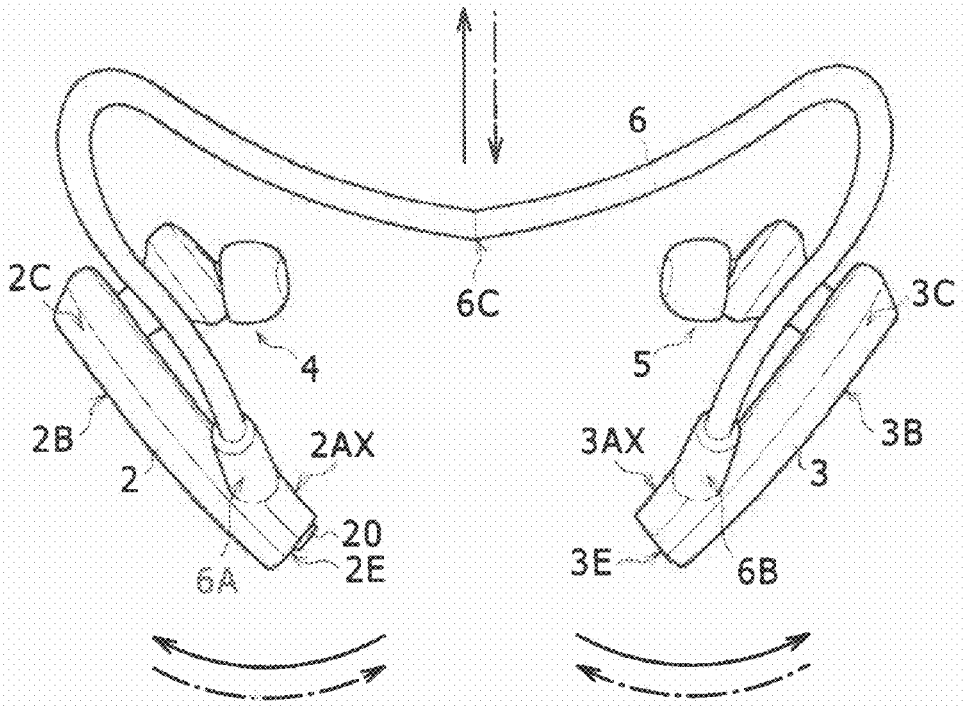
FIG. 7 is a schematic diagram showing the configuration of the headband when the right case and the left case are separated from each other.

Thus, as shown in FIG. 7, when the right case 2 and the left case 3 are separated (i.e. pulled apart) from each other and the center part of the headband 6 is expanded together with the bending angle of the bent part 6C, such elastic force as to return the expanded bending angle of the bent part 6C to the original bending angle occurs on the headband 6.

Thus, when the center part of the headband 6 is expanded together with the bending angle of the bent part 6C, the headband 6 can apply such a bias as to bring the right case 2 and the left case 3 closer to each other due to the elastic force occurring at the time.

Furthermore, when the right case 2 and the left case 3 are separated from each other and one end side and the other end side of the headband 6 are twisted with respect to the center part in such a way that the right case inside surface 2A and the left case inside surface 3A are made to face each other, such elastic force as to release the twisting of one end side and the other end side with respect to the center part occurs on the headband 6.

Thus, when one end side and the other end side are twisted with respect to the center part, the headband 6 can apply such a bias as to rotate the right case 2 and the left case 3 and make the right case one-end surface 2E and the left case one-end surface 3E face each other due to the elastic force occurring at the time.

Moreover, when one end side and the other end side in an arc shape are stretched into a bow shape in such a way that the center part is pulled away from the right case 2 and the left case 3 irrespective of whether the right case 2 and the left case 3 are connected to or separated from each other, such elastic force as to return the shape of one end side and the other end side to the original arc shape occurs on the headband 6.

Thus, when one end side and the other end side in an arc shape are stretched into a bow shape, the headband 6 can also apply such a bias as to locate the center part on the above-described same virtual plane and bring the center part closer to the right case 2 and the left case 3 due to the elastic force occurring at the time.

In the headphone-integrated reproducing apparatus 1, for example when the right case 2 held by the right hand and the left case 3 held by the left hand are separated from each other by the user, the center part of the headband 6 can be expanded so that the head may pass through the space between the right case 2 and the left case 3.

Thus, in the case of the headphone-integrated reproducing apparatus 1, if the right case 2 held by the right hand and the left case 3 held by the left hand are separated from each other by the user and the head is made to pass through the space between the right case 2 and the left case 3, the right headphone 4 and the left headphone 5 can be mounted on the auricle of the right and the auricle of the left. In the following description, the auricle of the right will be referred to also as the right auricle, and the auricle of the left will be referred to also as the left auricle.

Figure 8:
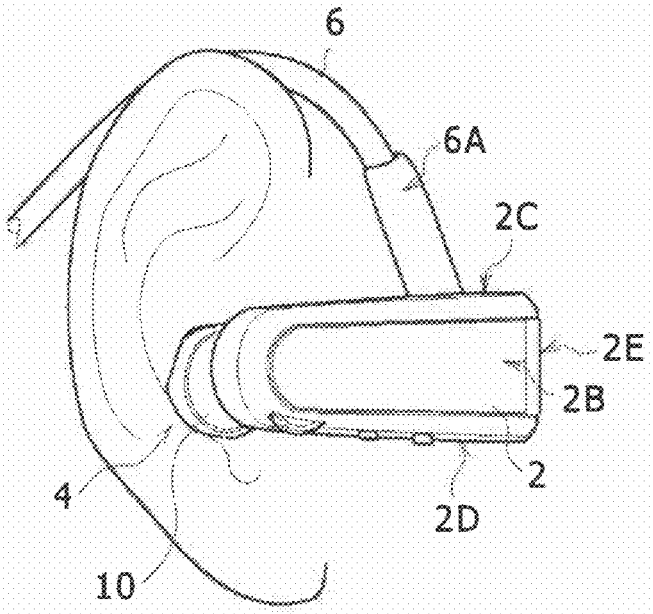
FIG. 8 is a schematic diagram (1) for explaining mounting of the headphone-integrated reproducing apparatus.
Figure 9:
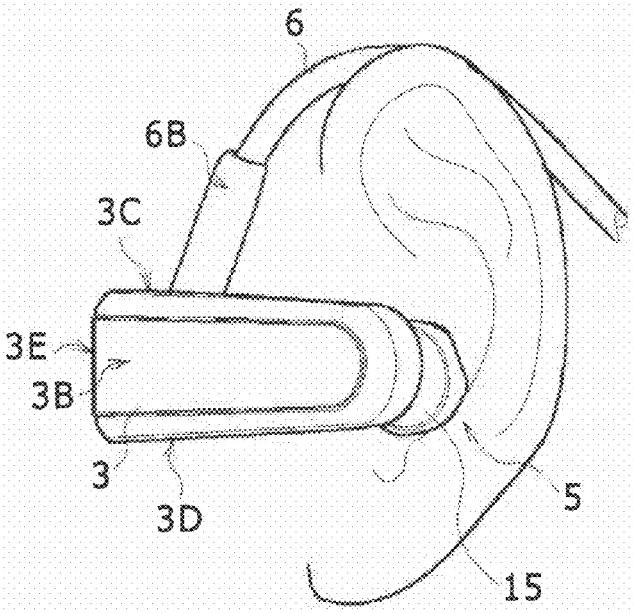
FIG. 9 is a schematic diagram (2) for explaining mounting of the headphone-integrated reproducing apparatus.
Figure 10:
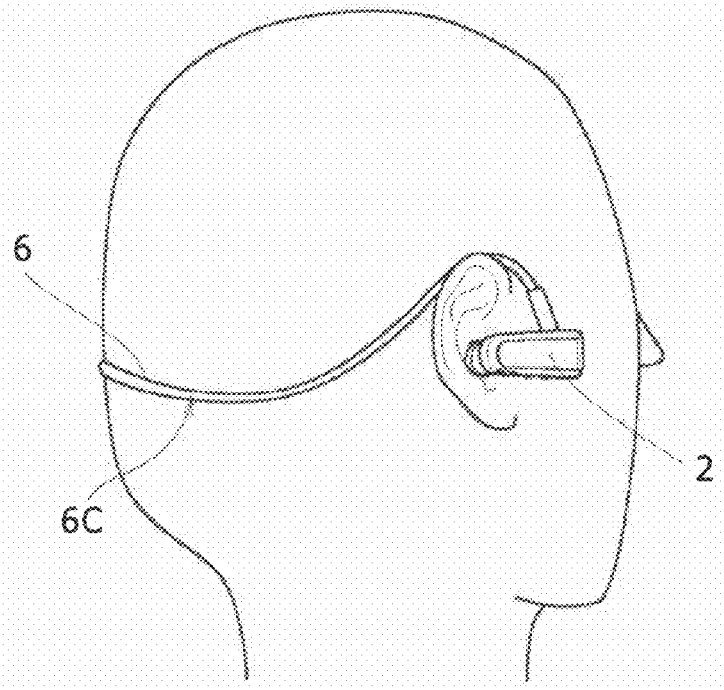
FIG. 10 is a schematic diagram (3) for explaining mounting of the headphone-integrated reproducing apparatus.

Specifically, as shown in FIGS. 8 to 10, in the case of the headphone-integrated reproducing apparatus 1, in the right auricle, the tip part 10B of the driver housing 10 of the right headphone 4 is inserted into the ear concha and the earpiece 12 of the right headphone 4 is inserted into the ear canal.

Furthermore, in the case of the headphone-integrated reproducing apparatus 1, in the left auricle, the tip part 15B of the driver housing 15 of the left headphone 5 is inserted into the ear concha and the earpiece 17 of the left headphone 5 is inserted into the ear canal. The ear concha and the ear canal will be referred to also as the ear hole collectively.

Moreover, on this occasion, as for the headband 6 of the headphone-integrated reproducing apparatus 1, one end part bent into an arc shape is brought close to the right auricle and located on the right side of the head and the other end part bent into an arc shape similarly is brought close to the left auricle and located on the left side of the head, and the center part is located on the back of the head.

Because the center part of the headband 6 is expanded together with the bending angle of the bent part 6C thereof at the time, the headphone-integrated reproducing apparatus 1 applies such a bias as to bring the right case 2 and the left case 3 closer to each other as described above.

Thus, in the case of the headphone-integrated reproducing apparatus 1, in the right auricle, the tip part 10B of the driver housing 10 of the right headphone 4 is slightly pressed against and brought into tight contact with the ear concha, and the earpiece 12 of the right headphone 4 is slightly pressed against and brought into tight contact with the ear canal.

Furthermore, in the case of the headphone-integrated reproducing apparatus 1, in the left auricle, the tip part 15B of the driver housing 15 of the left headphone 5 is slightly pressed against and brought into tight contact with the ear concha, and the earpiece 17 of the left headphone 5 is slightly pressed against and brought into tight contact with the ear canal.

Moreover, the headphone-integrated reproducing apparatus 1 makes one end part and the other end part of the headband 6 be slightly pressed against and brought into tight contact with the right-side head and the left-side head of the user.

Due to this feature, the headphone-integrated reproducing apparatus 1 allows the right headphone 4 and the left headphone 5 to be stably mounted on the right auricle and the left auricle of the user.

At the time, in the headband 6 of the headphone-integrated reproducing apparatus 1, one end side and the other end side are twisted with respect to the center part in such a way that the right case inside surface 2A of the right case 2 and the left case inside surface 3A of the left case 3 are made to face each other.

Thus, the headphone-integrated reproducing apparatus 1 applies such a bias as to rotate the right case 2 and the left case 3 and make the right case one-end surface 2E and the left case one-end surface 3E face each other as described above.

Consequently, the headphone-integrated reproducing apparatus 1 makes one end part (the step part 2AX) on the right case inside surface 2A of the right case 2 be slightly pressed against and brought into tight contact with the right cheek of the user, and makes one end part (the step part 3AX) on the left case inside surface 3A of the left case 3 be slightly pressed against and brought into tight contact with the left cheek of the user.

Due to this feature, the headphone-integrated reproducing apparatus 1 allows the right headphone 4 and the left headphone 5 to be further stably mounted on the right auricle and the left auricle of the user.

By the way, the users who wear the headphone-integrated reproducing apparatus 1 having such a configuration include both people having comparatively-large right auricle and left auricle and people having comparatively-small ones.

When the user has comparatively-large right auricle and left auricle, the headphone-integrated reproducing apparatus 1 allows one end part of the headband 6 to pass through the space between the back of the ear helix of the right auricle and the right-side head and allows the other end part of the headband 6 to pass through the space between the back of the ear helix of the left auricle and the left-side head.

Thus, the headphone-integrated reproducing apparatus 1 allows one end part and the other end part of the headband 6 to be hung on the ear helices of the right auricle and the left auricle to thereby allow the right headphone 4 and the left headphone 5 to be further stably mounted on the right auricle and the left auricle of the user.

In contrast, when the user has comparatively-small right auricle and left auricle, it is impossible for the headphone-integrated reproducing apparatus 1 to allow one end part of the headband 6 to pass through the space between the back side of the ear helix of the right auricle and the right-side head. Furthermore, when the user has comparatively-small right auricle and left auricle, it is also impossible for the headphone-integrated reproducing apparatus 1 to allow the other end part of the headband 6 to pass through the space between the back side of the ear helix of the left auricle and the left-side head.

However, also when the right auricle and the left auricle are comparatively-small, the headphone-integrated reproducing apparatus 1 biases one end part and the other end part of the headband 6 to bring them into tight contact with the right-side head and the left-side head, and therefore prevents failure in stable mounting of the right headphone 4 and the left headphone 5.

Moreover, at the time, the center part of the headband 6 is pressed against the back of the head and is pulled away from one end part and the other end part of the headband 6. Thus, the headphone-integrated reproducing apparatus 1 applies such a bias as to bring the center part of the headband 6 closer to one end part and the other end part.

Therefore, the headphone-integrated reproducing apparatus 1 makes the center part of the headband 6 be slightly pressed against and brought into tight contact with the back of the head of the user. Due to this feature, the headphone-integrated reproducing apparatus 1 allows the right headphone 4 and the left headphone 5 to be further stably mounted on the right auricle and the left auricle of the user.

Figure 11:
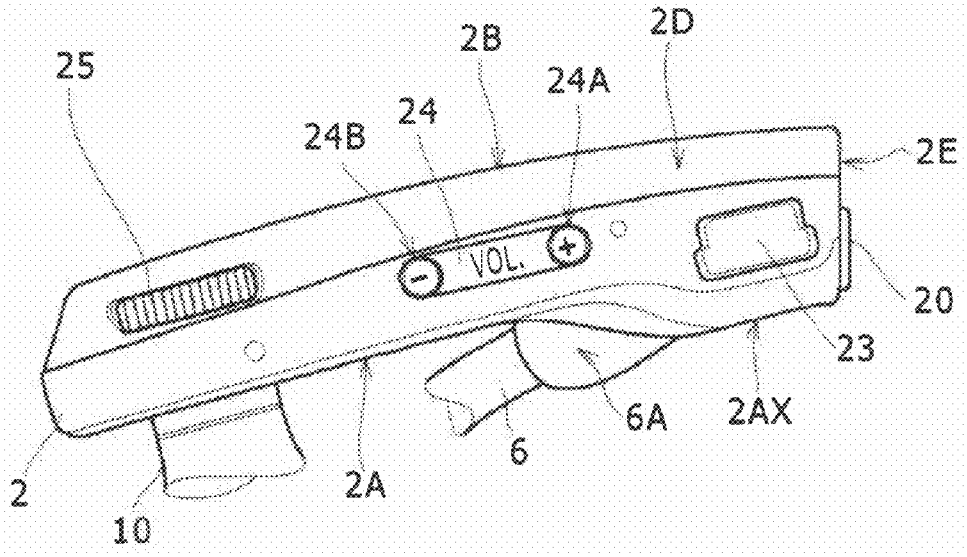
FIG. 11 is a schematic diagram showing the configuration of a right case lower surface of the right case.

By the way, as shown in FIG. 11, a connector 23 based on the universal serial bus (USB) standard is provided at one end part on the right case lower surface 2D of the right case 2.

The headphone-integrated reproducing apparatus 1 is connected to an external apparatus (not shown) such as a personal computer via the connector 23 and a USB cable (not shown) and communicates with it.

Thus, the headphone-integrated reproducing apparatus 1 can load and store music data and so on transferred from the external apparatus via the USB cable, and can charge the battery by power supplied from the external apparatus via the USB cable.

Furthermore, in the right case 2, a volume adjustment key 24 having a "U"-character shape is provided at the center part of the right case lower surface 2D in such a way that the longitudinal direction of the trunk part thereof is in parallel to the case longitudinal direction and protrusion parts 24A and 24B at both ends of the trunk part are slightly protruded from the right case lower surface 2D.

In the following description, the protrusion part 24A located closer to one end in the case longitudinal direction in the volume adjustment key 24 will be referred to also as the volume-up button 24A particularly, and the protrusion part 24B located closer to the other end in the case longitudinal direction will be referred to also as the volume-down button 24B particularly.

The headphone-integrated reproducing apparatus 1 sequentially turns up the volume of audio output via the right headphone 4 and the left headphone 5 one level by one level every time the volume-up button 24A of the volume adjustment key 24 is so press-down operated as to be pushed down into the right case 2 for a comparatively-short time.

Furthermore, the headphone-integrated reproducing apparatus 1 sequentially turns down the volume of audio output via the right headphone 4 and the left headphone 5 one level by one level every time the volume-down button 24B of the volume adjustment key 24 is so press-down operated as to be pushed down into the right case 2 for a comparatively-short time.

If the volume-up button 24A continues to be press-down operated (i.e. continues to be pushed), the headphone-integrated reproducing apparatus 1 continuously turns up the volume of audio output via the right headphone 4 and the left headphone 5 in the meantime.

If the volume-down button 24B continues to be press-down operated (i.e. continues to be pushed), the headphone-integrated reproducing apparatus 1 continuously turns down the volume of audio output via the right headphone 4 and the left headphone 5 in the meantime.

Furthermore, in the right case 2, a rotational operation element 25 that allows press-down operation and rotational operation is provided at the other end part of the right case lower surface 2D and closer to the right case outside surface 2B in such a way that a part of the fringe thereof is slightly protruded from the right case lower surface 2D.

In the following description, this rotational operation element 25 will be referred to also as the jog dial 25. Furthermore, in the following description, a part of the fringe of the jog dial 25 slightly protruded from the right case lower surface 2D of the right case 2 will be referred to also as the protrusion part.

In practice, the center axis of the jog dial 25 substantially corresponds with the center axis of the driver housing 10 of the right headphone 4, or is so located as to be in parallel to the center axis of the driver housing 10 and slightly closer to the right case lower surface 2D than this center axis.

In the headphone-integrated reproducing apparatus 1, the jog dial 25 can be so press-down operated as to be pushed down into the right case 2 for a comparatively-short time and can also be so press-down operated as to be pushed down for a comparatively-long time in such a way that a finger or the like is pressed against the protrusion part of the jog dial 25.

Furthermore, in the headphone-integrated reproducing apparatus 1, the jog dial 25 can also be rotationally operated in one direction and the other direction in such a way that a finger or the like made to abut against the protrusion part of the jog dial 25 is moved toward one end side and the other end side in the case longitudinal direction.

In the following description, press-down operation in which the jog dial 25 is pushed down into the right case 2 for a comparatively-short time (e.g. for a time shorter than one second) will be referred to also as short-press operation particularly. Furthermore, in the following description, press-down operation in which the jog dial 25 is pushed down into the right case 2 for a comparatively-long time (e.g. for a time equal to or longer than one second) will be referred to also as long-press operation particularly.

In addition, in the following description, the rotational operation of the jog dial 25 in one direction (i.e. anticlockwise rotational operation in front view of the right case outside surface 2B of the right case 2) will be referred to also as + rotation operation particularly.

Moreover, in the following description, the rotational operation of the jog dial 25 in the other direction (i.e. clockwise rotational operation in front view of the right case outside surface 2B of the right case 2) will be referred to also as – rotation operation particularly.

The headphone-integrated reproducing apparatus 1 allows input of plural kinds of commands such as reproduction start and reproduction stop by these various kinds of operation of the jog dial 25.

Figure 12:
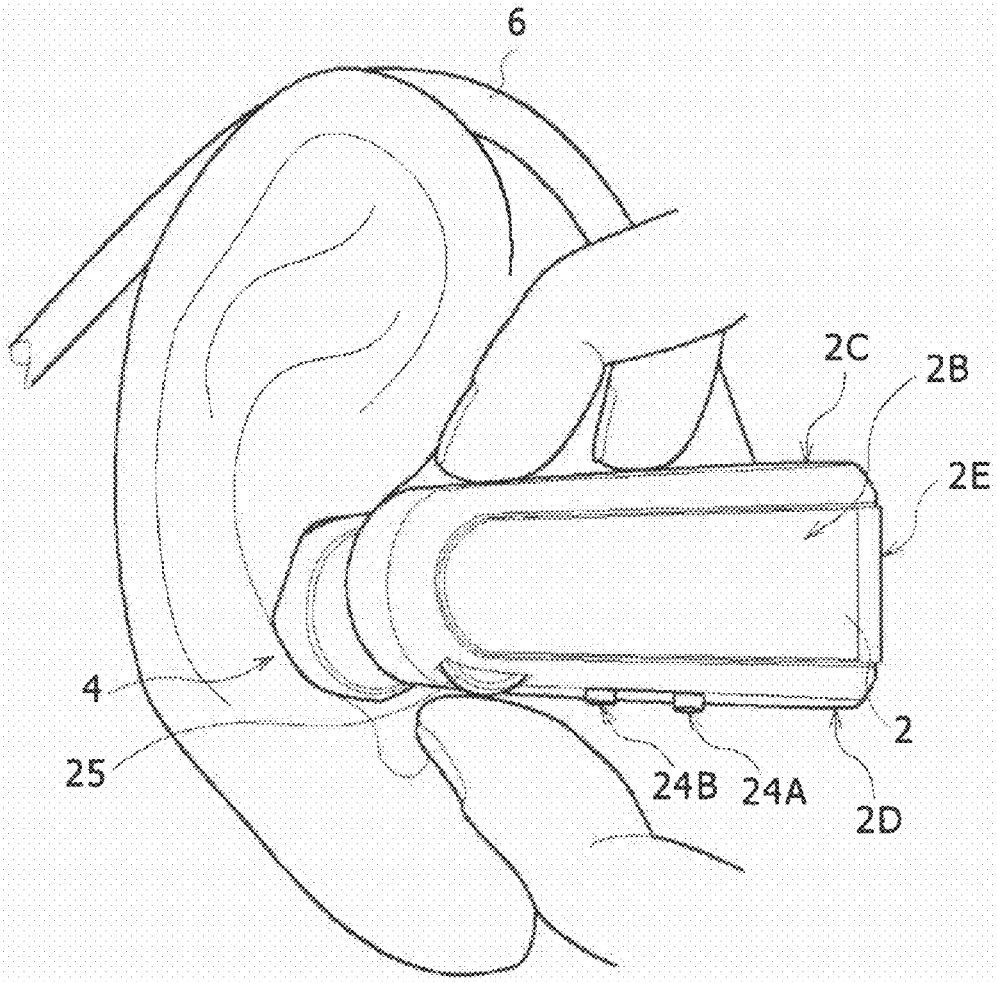
FIG. 12 is a schematic diagram for explaining operation of a jog dial.

By the way, as shown in FIG. 12, when the user raises the right hand and the left hand to the level of the right auricle and the left auricle, the thumb is naturally located on the lower side whereas the other four fingers from the index finger to the little finger are located above the thumb because of the human body structure.

Thus, in mounting of the headphone-integrated reproducing apparatus 1 on a user, for example, the user can sandwich the right case 2 in such a way that only the index finger of the right hand or the index finger and the middle finger thereof are placed on the right case upper surface 2C of the right case 2 and the thumb of the right hand is placed on the right case lower surface 2D.

In the headphone-integrated reproducing apparatus 1, in the right headphone 4 provided at the other end part of the right case 2 as described above, the tip part 10B of the driver housing 10 is inserted into and brought into tight contact with the ear concha of the right auricle, and the earpiece 12 is inserted into and brought into tight contact with the ear canal of the right auricle.

Furthermore, in the headphone-integrated reproducing apparatus 1, the protrusion part of the jog dial 25 is protruded from the other end part of the right case lower surface 2D of the right case 2 as described above.

Specifically, in the headphone-integrated reproducing apparatus 1, the protrusion part of the jog dial 25 is located close to the right headphone 4 (i.e. the ear canal of the right auricle), and the protrusion part of the jog dial 25 is located vertically below the right headphone 4 when the headphone-integrated reproducing apparatus 1 is mounted on a user.

Thus, in the case of the headphone-integrated reproducing apparatus 1, the belly of the thumb of the right hand can be easily brought into contact with the protrusion part of the jog dial 25 by only bringing the fingers of the right hand close to the ear canal of the right auricle and making the fingers sandwich the other end part of the right case 2, although the user can not directly view the right case 2 mounted on the right auricle.

In the headphone-integrated reproducing apparatus 1, on the right case lower surface 2D of the right case 2, the protrusion part of the jog dial 25 is located closer to the right case outside surface 2D and separated from the right case inside surface 2A by as large a distance as possible as described above.

Therefore, in the case of the headphone-integrated reproducing apparatus 1, in the right hand sandwiching the right case 2, the thumb can be accurately brought into contact with the protrusion part of the jog dial 25 without contact with the right auricle of the user, the periphery thereof, and so on.

In the headphone-integrated reproducing apparatus 1, press-down operation and rotational operation of the jog dial 25 are carried out by the thumb of the right hand sandwiching the other end part of the right case 2 in such a state that the other end part of the right case 2 is so held as to be fixed to the right auricle with the intermediary of the right headphone 4 as described above.

Thus, the headphone-integrated reproducing apparatus 1 can prevent the right case 2 from wobbling and can also prevent the right case 2 from rotating about the driver housing 10 relative to the right auricle when press-down operation and rotational operation of the jog dial 25 are carried out by the thumb of the right hand.

That is, the headphone-integrated reproducing apparatus 1 allows press-down operation and rotational operation of the jog dial 25 to be carried out easily and accurately by the thumb of the right hand sandwiching the right case 2.

Moreover, in the headphone-integrated reproducing apparatus 1, in the right case 2, the volume adjustment key 24 is provided at a position as close as possible to the other end part, which is so held as to be fixed to the right auricle with the intermediary of the right headphone 4.

Thus, in the case of the headphone-integrated reproducing apparatus 1, when the right case 2 is sandwiched by the right hand of the user in such a way that the right hand is located slightly closer to the face front side than the ear canal of the right auricle, the thumb of the right hand can be brought into contact with the volume adjustment key 24 at the center part of the right case lower surface 2D easily and accurately.

Furthermore, the headphone-integrated reproducing apparatus 1 can prevent the right case 2 from wobbling and can also prevent the right case 2 from rotating about the driver housing 10 relative to the right auricle when press-down operation of the volume adjustment key 24 is carried out by the thumb of the right hand.

That is, the headphone-integrated reproducing apparatus 1 also allows press-down operation of the volume adjustment key 24 to be carried out easily and accurately by the thumb of the right hand sandwiching the right case 2.

As above, in the headphone-integrated reproducing apparatus 1, the jog dial 25 and the volume adjustment key 24 are provided on the right case lower surface 2D of the right case 2. Thus, they can be operated by using only the right hand without using the left hand when the headphone-integrated reproducing apparatus 1 is mounted.

Figure 13:
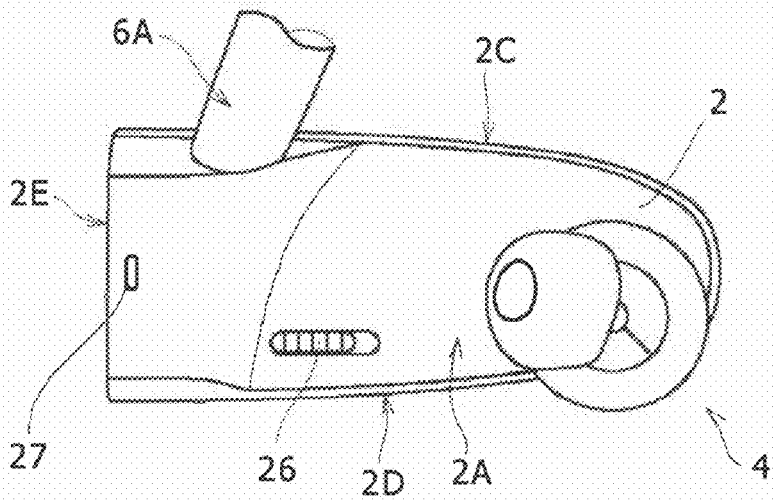
FIG. 13 is a schematic diagram showing the configuration of a right case inside surface of the right case.

In addition, as shown in FIG. 13, a reproduction order changeover switch 26 for arbitrarily changing the reproduction order of plural music data from one of different two kinds of reproduction order to the other is slidably provided at the center part of the right case inside surface 2A of the right case 2.

The headphone-integrated reproducing apparatus 1 holds an order specifying list that specifies the reproduction order of plural music data as described later.

Thus, when the reproduction order changeover switch 26 is slide operated toward the other end side in the case longitudinal direction for example, the headphone-integrated reproducing apparatus 1 changes the reproduction order of the plural music data to the reproduction order indicated by the order specifying list.

Furthermore, when the reproduction order changeover switch 26 is slide operated toward one end side in the case longitudinal direction for example, the headphone-integrated reproducing apparatus 1 changes the reproduction order of the plural music data to a reproduction order arising from random rearrangement of the reproduction order indicated by the order specifying list.

In the following description, the reproduction order indicated by the order specifying list will be referred to also as the specified reproduction order, and the reproduction order arising from random rearrangement of the specified reproduction order indicated by the order specifying list will be referred to also as the shuffle reproduction order.

A light emitter 27 for notifying the user of the remaining amount of the battery (hereinafter, it will be referred to also as the remaining amount notifying light emitter) is provided close to one end of the right case inside surface 2A of the right case 2.

During the operation, the headphone-integrated reproducing apparatus 1 changes the emission color of the remaining amount notifying light emitter 27 depending on the remaining amount of the battery and can notify the user of the remaining amount of the battery by this emission color.

For example, when the battery is full-charged, the headphone-integrated reproducing apparatus 1 makes the remaining amount notifying light emitter 27 emit green light. In linkage with decrease in the remaining amount of the battery, the headphone-integrated reproducing apparatus 1 sequentially changes the emission color of the remaining amount notifying light emitter 27 from green to orange and then finally red.

Figure 14:
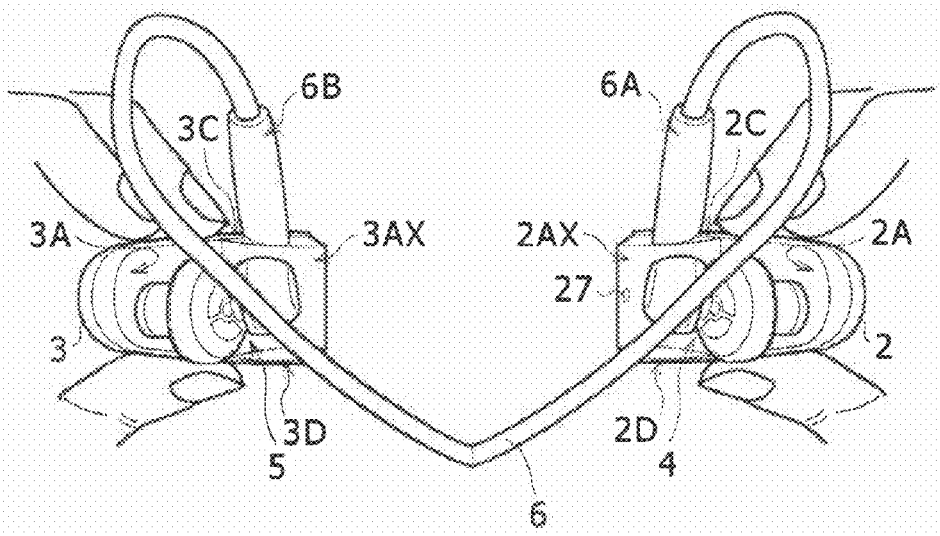
FIG. 14 is a schematic diagram for explaining the state when the headphone-integrated reproducing apparatus is removed from a right auricle and a left auricle.

As shown in FIG. 14, when the headphone-integrated reproducing apparatus 1 is removed from the right auricle and left auricle of the user and located in front of the user's body while the right case 2 is held by the right hand and the left case 3 is held by the left hand, the remaining amount notifying light emitter 27 as well as the right case inside surface 2A can be brought into view.

Thus, the headphone-integrated reproducing apparatus 1 can notify the user of the remaining amount of the battery by the emission color of the remaining amount notifying light emitter 27.

Figure 15:
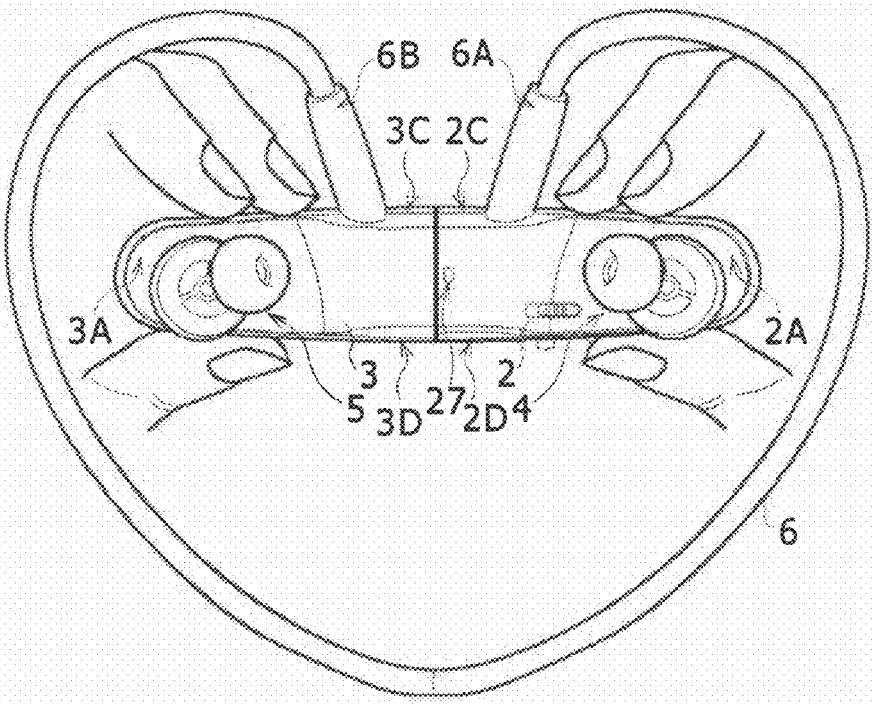
FIG. 15 is a schematic diagram for explaining notification of the remaining amount of a battery by a remaining amount notifying light emitter when the right case and the left case are connected to each other.

As shown in FIG. 15, when the headphone-integrated reproducing apparatus 1 is removed from the right auricle and left auricle of the user and the right case 2 and the left case 3 are connected to each other in front of the user's body while they are held by the right hand and the left hand, the remaining amount notifying light emitter 27 as well as the right case inside surface 2A can be oriented toward the user's face.

Thus, in this case, the headphone-integrated reproducing apparatus 1 allows the user to view the remaining amount notifying light emitter 27 straightforward and accurately check the emission color, and thereby can accurately notify the user of the remaining amount of the battery.

Figure 16:
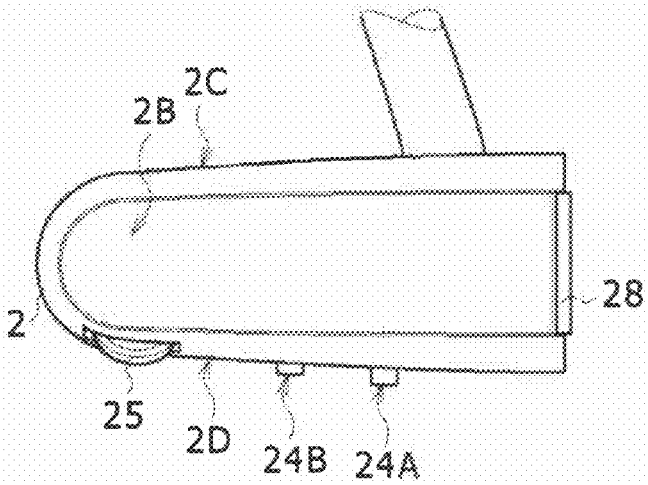
FIG. 16 is a schematic diagram showing the configuration of a right case outside surface of the right case.

As shown in FIG. 16, in the right case 2, a strip light emitter 28 for notifying the user of the status of the headphone-integrated reproducing apparatus 1 (hereinafter, it will be referred to also as the status notifying light emitter) is provided along one end line of the right case outside surface 2B.

The headphone-integrated reproducing apparatus 1 makes the status notifying light emitter 28 emit e.g. white light while being connected to an external apparatus via a USB cable, while storing music data transferred from the external apparatus, while charging the battery by power supplied from the external apparatus, and so on.

However, the headphone-integrated reproducing apparatus 1 changes the emission state (specifically, lighting, blinking, the blinking interval, and so on) of the status notifying light emitter 28 responding to the status of being connected to an external apparatus, the status of storing music data, the status of charging the battery, and so on.

Thus, the headphone-integrated reproducing apparatus 1 can notify the user of the status of the headphone-integrated reproducing apparatus 1 by the emission state of the status notifying light emitter 28.

Also in response to connection of the right case 2 and the left case 3, the headphone-integrated reproducing apparatus 1 can notify the user of this connection by making the status notifying light emitter 28 emit white light one time.

[1-2 Internal Configuration of Headphone-Integrated Reproducing Apparatus]

Figure 17:
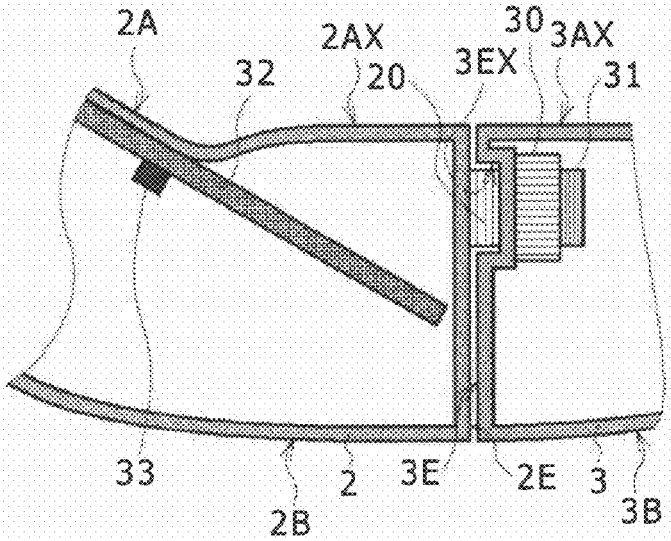
FIG. 17 is a schematic diagram showing the internal configuration of the headphone-integrated reproducing apparatus.
Figure 18:
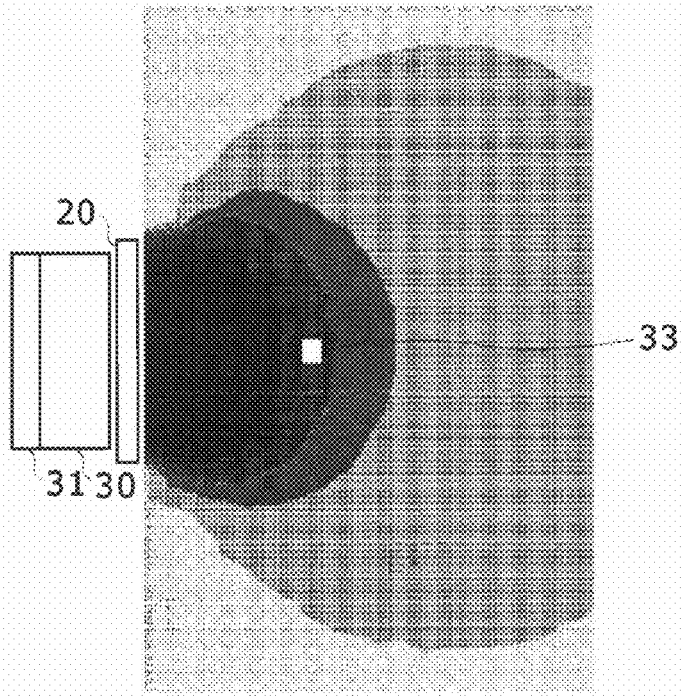
FIG. 18 is a schematic diagram (1) for explaining change in the intensity of an applied magnetic field on a detector dependent on the distance between an adsorption plate and a magnet.
Figure 19:
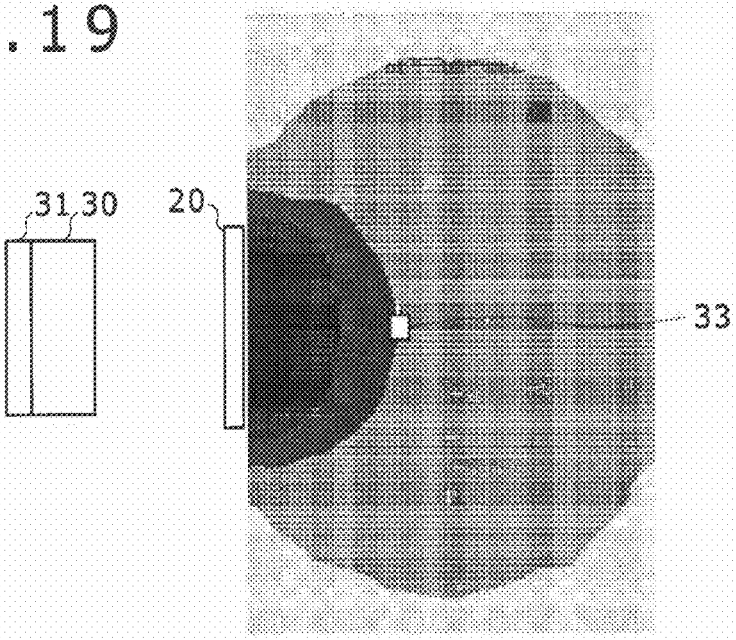
FIG. 19 is a schematic diagram (2) for explaining the change in the intensity of the applied magnetic field on the detector dependent on the distance between the adsorption plate and the magnet.
Figure 20:
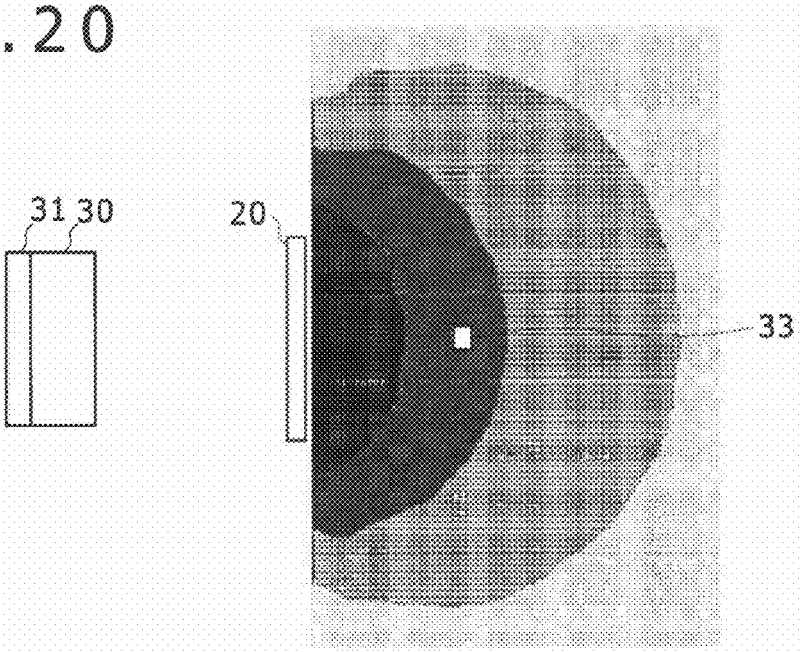
FIG. 20 is a schematic diagram (3) for explaining the change in the intensity of the applied magnetic field on the detector dependent on the distance between the adsorption plate and the magnet.
Figure 21:
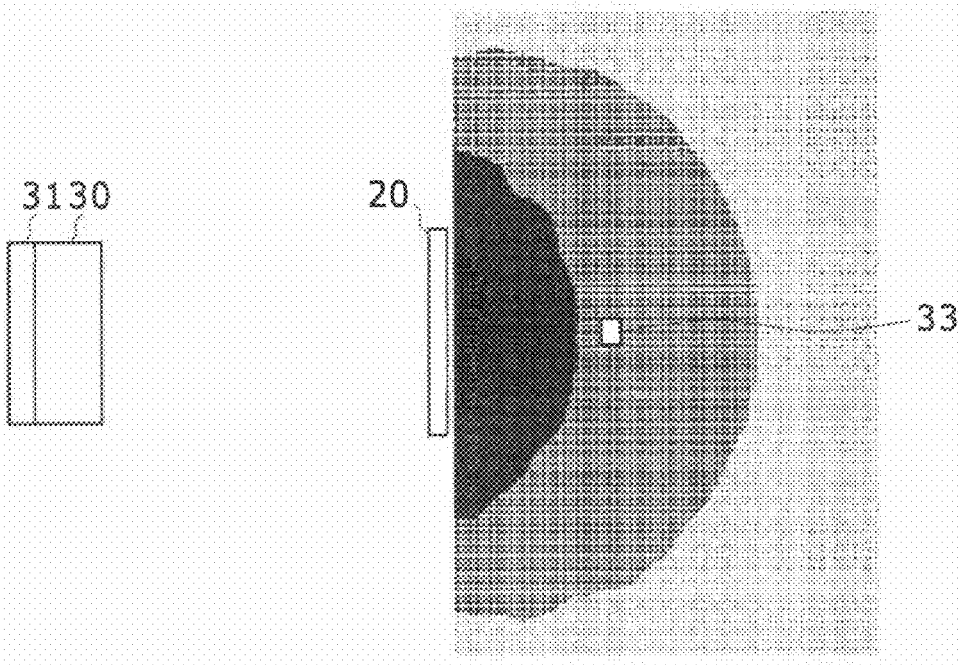
FIG. 21 is a schematic diagram (4) for explaining the change in the intensity of the applied magnetic field on the detector dependent on the distance between the adsorption plate and the magnet.

The internal configuration of the headphone-integrated reproducing apparatus 1 will be described below with reference to FIG. 17. As shown in FIG. 17, the above-described magnet 30 is housed inside the left case 3 in the headphone-integrated reproducing apparatus 1 in such a way that the end surface of the N-pole abuts against the back side of the bottom plate of the adsorption plate housing 3EX and the end surface of the S-pole is oriented toward the other end side in the case longitudinal direction.

A yoke 31 for amplifying the adsorption force of the magnet 30 is so housed inside the left case 3 that one surface thereof abuts against the end surface of the S-pole of the magnet 30.

On the other hand, a circuit board 32 is housed inside the right case 2 as described above. At a predetermined position on one surface of the circuit board 32, a detector 33 having a magnetic sensor (magnetic sensor formed of a magnetic thin film element formed on a silicon substrate) based on e.g. giant magnet resistance effect (GMR) is mounted as a circuit element.

As shown in FIGS. 18 to 21, when the magnet 30 is brought close to the detector 33, the magnetic field generated by this magnet 30 is applied to the detector 33. In the following description, the magnetic field applied to the detector 33 will be referred to also as the applied magnetic field.

The intensity (i.e. the magnetic flux density) of the applied magnetic field on the detector 33 becomes the highest when the adsorption plate 20 is adsorbed by the magnet 30 and the right case 2 and the left case 3 are connected to each other (i.e. when the magnet 30 is brought closest to the detector 33).

That is, the intensity (i.e. the magnetic flux density) of the applied magnetic field on the detector 33 becomes lower as the distance between the right case 2 and the left case 3 is increased.

Therefore, the detector 33 detects whether or not the right case 2 and the left case 3 are connected to each other based on change in the intensity (i.e. the magnetic flux density) of the applied magnetic field.

The headphone-integrated reproducing apparatus 1 is mounted on the right auricle and the left auricle at the time of music listening. However, the right case 2 and the left case 3 can be connected to each other for arranging the entire apparatus into a compact form when the headphone-integrated reproducing apparatus 1 is carried, when it is put on a desk or the like after the end of use thereof, or the like.

In matching with such usage, in which the right case 2 and the left case 3 are connected to each other when the headphone-integrated reproducing apparatus 1 is not used, if connection of the right case 2 and the left case 3 is detected by the detector 33 as described later, the headphone-integrated reproducing apparatus 1 carries out predetermined control depending on the detection result.

In this manner, when the right case 2 and the left case 3 are connected to each other with the intermediary of the adsorption plate 20 and the magnet 30, the headphone-integrated reproducing apparatus 1 is allowed to carry out the predetermined control without any control of the jog dial 25 and so on at the time.

[1-3 Circuit Configuration of Headphone-Integrated Reproducing Apparatus]

Figure 22:
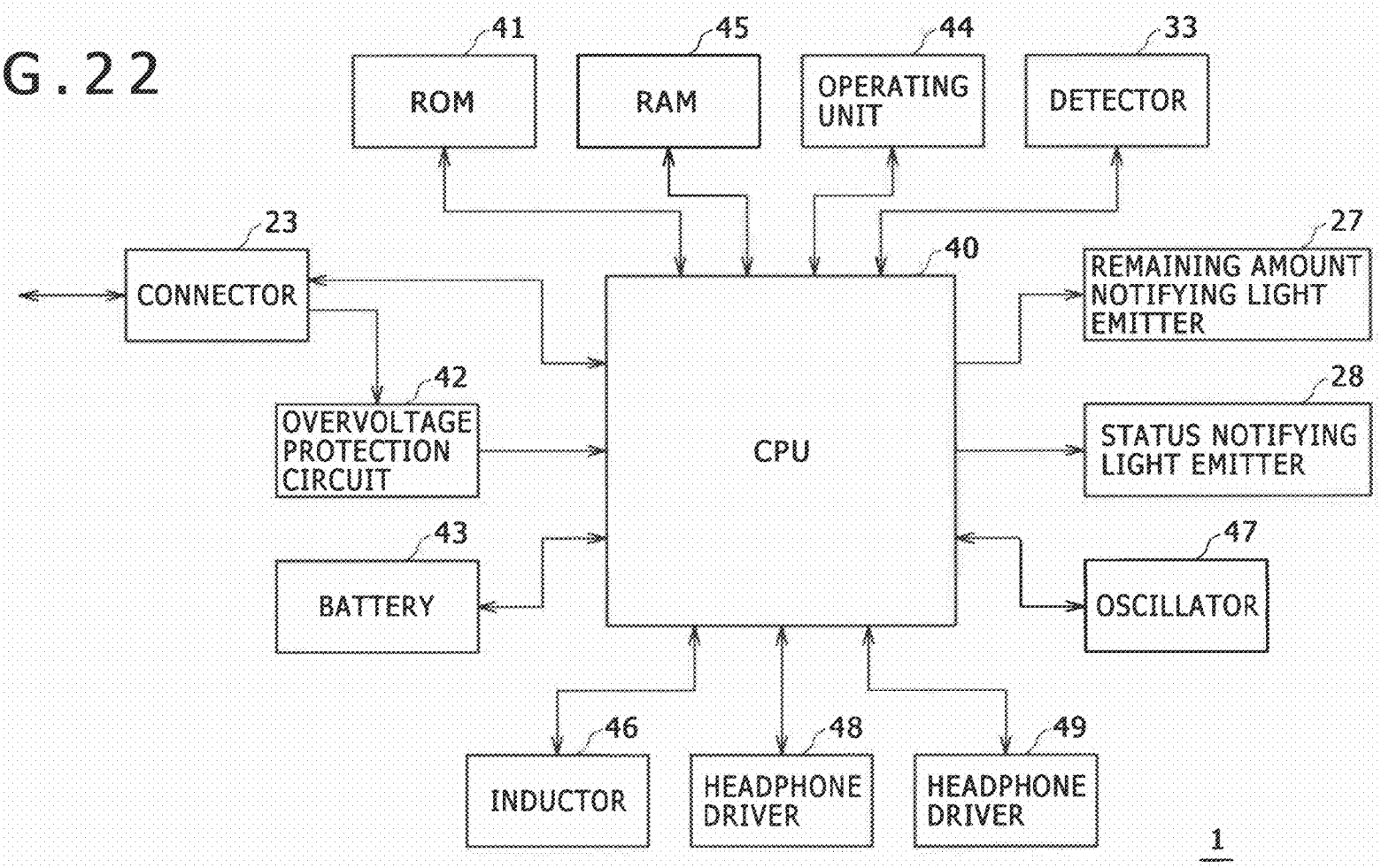
FIG. 22 is a block diagram showing the circuit configuration of the headphone-integrated reproducing apparatus.

The circuit configuration of the headphone-integrated reproducing apparatus 1 will be described below with reference to FIG. 22. When the headphone-integrated reproducing apparatus 1 is connected to an external apparatus via a USB cable (not shown), a CPU 40 in the headphone-integrated reproducing apparatus 1 dependently operates based mainly on the external apparatus.

Thus, in response to transfer of one or plural music data from the external apparatus, the CPU 40 loads the transferred music data via the connector 23 and sends out the music data to a ROM 41 formed of a flash memory to store the music data in the ROM 41.

The following description is based on the assumption that each of the music data transferred from the external apparatus is music data for one track, for simplified description. To this music data, e.g. a file name created by utilizing the title (i.e. track name) of the music based on the music data is added.

Therefore, upon storing all of the music data transferred from the external apparatus by one time of transfer processing in the ROM 41, the CPU 40 reads out the file names of the music data stored at the time and the file names of all of the music data stored by previous transfer processing.

Subsequently, the CPU 40 arranges these file names e.g. in alphabetical order. Based on the arrangement of the file names, the CPU 40 creates the order specifying list that specifies the reproduction order of the corresponding music data, and sends out the created order specifying list to the ROM 41 to store it therein.

By the way, as the external apparatus connected to the headphone-integrated reproducing apparatus 1, there is e.g. an apparatus that can extract, from music data, the energy of each of the frequency bands each corresponding to a respective one of twelve tones in one octave and can analyze characteristics of the music based on the extracted energy of each frequency band.

In practice, the external apparatus with such configuration detects musical instruments used in playing of music, chords, tempos, and so on based on the energy of each frequency band of the music data, for example.

Furthermore, based on the result of the detection of chords, tempos, and so on, the external apparatus with such configuration specifies the start position of the part called "hook-line" as the characteristic part of the music (i.e. the position corresponding to the start of "hook-line," and hereinafter it will be referred to also as the hook-line start position).

At the time of transfer of music data, the external apparatus with such configuration transfers, in addition to the music data as the transfer subject, the hook-line start position specified about this music data as start position information to the headphone-integrated reproducing apparatus 1.

Thus, when the start position information is transferred together with the music data from the external apparatus, the CPU 40 in the headphone-integrated reproducing apparatus 1 sends out the music data together with the start position information to the ROM 41 and stores the music data and the start position information associated with each other in the ROM 41.

In this manner, the CPU 40 can store plural music data in the ROM 41 and update the content of the order specifying list every time music data is additively stored in the ROM 41.

Furthermore, upon being supplied with charge power for charging the battery from the external apparatus, the CPU 40 captures the charge power via an overvoltage protection circuit 42 and supplies the power to a battery 43 via a power supply circuit (not shown) inside the CPU 40.

In this manner, the CPU 40 can charge the battery 43 based on the charge power supplied from the external apparatus.

When the headphone-integrated reproducing apparatus 1 is connected to an external apparatus, while the CPU 40 loads music data transferred from the external apparatus and stores the data in the ROM 41, and while the battery 43 is charged, the CPU 40 generates a light emission control signal corresponding to these statuses.

The CPU 40 sends out the light emission control signal to the status notifying light emitter 28 to thereby control the status notifying light emitter 28 based on the light emission control signal and make it emit light with the emission state dependent on the status of the headphone-integrated reproducing apparatus 1.

Thus, when the headphone-integrated reproducing apparatus 1 is connected to an external apparatus, the CPU 40 allows the user to check which status the headphone-integrated reproducing apparatus 1 is in through the notification by the status notifying light emitter 28.

On the other hand, when an external apparatus is not connected to the headphone-integrated reproducing apparatus 1, the CPU 40 operates even solely in response to the operation of an operating unit 44 (i.e. the above-described volume adjustment key 24, jog dial 25, and reproduction order changeover switch 26) and so on.

In practice, the CPU 40 determines that a power-on command is input if short-press operation of the jog dial 25 is carried out in the power-off state in which execution of various kinds of processing, control of the respective circuit blocks, and so on are stopped.

At this time, the CPU 40 captures the power supplied from the battery 43 into the inside power supply circuit and generates operating power for operating the respective circuit blocks (including the CPU 40).

Then, the CPU 40 enters the power-on state in which it can execute various kinds of processing and control of the respective circuit blocks by its own operating power, and starts the operation.

Furthermore, at this time the CPU 40 supplies each of the circuit blocks with the corresponding operating power and makes these circuit blocks enter the operable state.

In the power-off state, the CPU 40 sets the circuit element on which the jog dial 25 is mounted to such a state as to be capable of detecting only short-press operation for input of a power-on command. Thus, the CPU 40 allows the user to input only the power-on command via the jog dial 25.

When the CPU 40 charges the battery 43 by the charge power or captures supply power from the battery 43, the CPU 40 uses an inductor 46 connected to the power supply circuit to suppress noise on the charge power and the supply power and perform rectification and smoothing.

The CPU 40 stores, in the ROM 41, various programs such as application programs typified by a basic program, a reproduction control program, and an operation control program in advance.

Thus, if the power-on state starts without connection to an external apparatus, the CPU 40 reads out various programs from the ROM 41 and expands them in a random access memory (RAM) 45 in response to various commands input depending on user's operation of the operating unit 44, and so on.

Therefore, the CPU 40 controls the entire apparatus (i.e. the respective circuit blocks) and executes various kinds of processing in accordance with the various programs expanded in the RAM 45.

In the power-on state, the CPU 40 operates at the timing of an operating clock generated by an oscillator 47, and supplies the operating clock to the respective circuit blocks to make these circuit blocks also operate at the timing of the operating clock.

Based on this configuration, for example, if the CPU 40 determines that a selection command for selecting the specified reproduction order is input in response to slide operation of the reproduction order changeover switch 26, the CPU 40 sets the reproduction order of plural music data to the specified reproduction order in response to this.

In contrast, if the CPU 40 determines that a selection command for selecting a shuffle reproduction order is input in response to slide operation of the reproduction order changeover switch 26, the CPU 40 sets the reproduction order of plural music data to the shuffle reproduction order.

When short-press operation, long-press operation, + rotation operation, or − rotation operation of the jog dial 25 is carried out, the CPU 40 carries out reproduction control of music data in response to this operation. Specifically, the CPU 40 carries out changeover of the reproduction mode of music data reproduction and reproduction control of the music data, such as reproduction start, reproduction stop, track forwarding, and track backing.

The CPU 40 has, as the reproduction mode, a normal reproduction mode in which reproduction from the beginning position to the end position of music data (it will be referred to also as normal reproduction) is performed, and a hook-line reproduction mode in which reproduction of only the part equivalent to the hook-line (it will be referred to also as hook-line reproduction) is performed. In the following description, the part equivalent to the hook-line of music in music data will be referred to also as the hook-line part.

In normal reproduction, the CPU 40 reads out music data from the ROM 41, and executes reproduction processing including decode processing, digital-analog conversion processing, amplification processing, and so on for the read music data to thereby produce music signals for the right channel and the left channel.

The CPU 40 sends out the music signal for the right channel to a headphone driver 48 of the right headphone 4, and sends out the music signal for the left channel to a headphone driver 49 of the left headphone 5.

Thus, the CPU 40 controls driving of the headphone driver 48 based on the music signal for the right channel, for outputting music for the right channel from the right headphone 4.

Furthermore, the CPU 40 controls driving of the headphone driver 49 based on the music signal for the left channel, for outputting music for the left channel from the left headphone 5.

In this manner, the CPU 40 allows the user to listen to stereo music via the right headphone 4 and the left headphone 5.

On the other hand, in hook-line reproduction, the CPU 40 reads out music data from the ROM 41. At the time, if the music data read out from the ROM 41 is associated with start position information, the CPU 40 also reads out the start position information from the ROM 41.

Furthermore, the CPU 40 regards the part corresponding to a predetermined reproducing time from the hook-line start position indicated by the start position information in the music data as the hook-line part, and executes reproduction processing similar to the above-described processing for the hook-line part to thereby produce hook-line part signals for the right channel and the left channel.

The CPU 40 sends out the hook-line part signal for the right channel to the headphone driver 48 of the right headphone 4, and sends out the hook-line part signal for the left channel to the headphone driver 49 of the left headphone 5.

Thus, the CPU 40 controls driving of the headphone driver 48 based on the hook-line part signal for the right channel, for outputting the part corresponding to the predetermined reproducing time from the beginning of the hook-line, of music for the right channel, from the right headphone 4.

Furthermore, the CPU 40 controls driving of the headphone driver 49 based on the hook-line part signal for the left channel, for outputting the part corresponding to the predetermined reproducing time from the beginning of the hook-line, of music for the left channel, from the left headphone 5.

In the hook-line reproduction, if the music data read out from the ROM 41 is not associated with start position information, the CPU 40 reads out only the music data from the ROM 41.

In this case, the CPU 40 specifies, as the hook-line start position, the position distant from the beginning position by a predetermined reproducing time (e.g. 45 seconds) selected in advance in the music data.

Thus, in this case, the CPU 40 regards the part corresponding to the predetermined reproducing time from the specified hook-line start position in the music data as the hook-line part, and executes reproduction processing similar to the above-described processing for the hook-line part to thereby produce hook-line part signals for the right channel and the left channel.

The CPU 40 sends out the hook-line part signal for the right channel to the headphone driver 48 of the right headphone 4, and sends out the hook-line part signal for the left channel to the headphone driver 49 of the left headphone 5.

Thus, the CPU 40 controls driving of the headphone driver 48 based on the hook-line part signal for the right channel, for outputting the part corresponding to the predetermined reproducing time from the beginning of the hook-line, of music for the right channel, from the right headphone 4.

Furthermore, the CPU 40 controls driving of the headphone driver 49 based on the hook-line part signal for the left channel, for outputting the part corresponding to the predetermined reproducing time from the beginning of the hook-line, of music for the left channel, from the left headphone 5.

In this manner, the CPU 40 allows the user to listen to the hook-line of stereo music via the right headphone 4 and the left headphone 5.

The CPU 40 can reproduce not only music data but also guide data. Also in guide data reproduction, similarly to normal reproduction of music data, the CPU 40 reads out guide data from the ROM 41 and executes reproduction processing for the read guide data to thereby produce audio signals for the right channel and the left channel.

The CPU 40 sends out the audio signal for the right channel to the headphone driver 48 of the right headphone 4, and sends out the audio signal for the left channel to the headphone driver 49 of the left headphone 5.

Thus, the CPU 40 controls driving of the headphone driver 48 based on the audio signal for the right channel, for outputting an audio guide or a sound effect for the right channel from the right headphone 4.

Furthermore, the CPU 40 controls driving of the headphone driver 49 based on the audio signal for the left channel, for outputting an audio guide or a sound effect for the left channel from the left headphone 5.

In this manner, the CPU 40 allows the user to listen to the audio guide or the sound effect via the right headphone 4 and the left headphone 5.

In the case of performing normal reproduction or hook-line reproduction in the state in which the reproduction order of plural music data is set to the specified reproduction order, the CPU 40 sequentially reproduces the whole part from the beginning position to the end position or the hook-line part of each of the plural music data in the specified reproduction order indicated by the order specifying list.

In the case of performing normal reproduction or hook-line reproduction in the state in which the reproduction order of plural music data is set to a shuffle reproduction order, the CPU 40 decides the shuffle reproduction order by randomly rearranging the specified reproduction order indicated by the order specifying list, for example.

Furthermore, the CPU 40 sequentially reproduces the whole part from the beginning position to the end position or the hook-line part of each of the plural music data in the shuffle reproduction order.

In this manner, in the case of performing normal reproduction in the state in which the reproduction order of plural music data is set to the specified reproduction order or the shuffle reproduction order, the CPU 40 carries out the same reproduction control basically, except for that the reproduction order of these plural music data is different.

Also in the case of performing hook-line reproduction in the state in which the reproduction order of plural music data is set to the specified reproduction order or the shuffle reproduction order, the CPU 40 carries out the same reproduction control basically, except for that the reproduction order of these plural music data is different.

Figure 23:
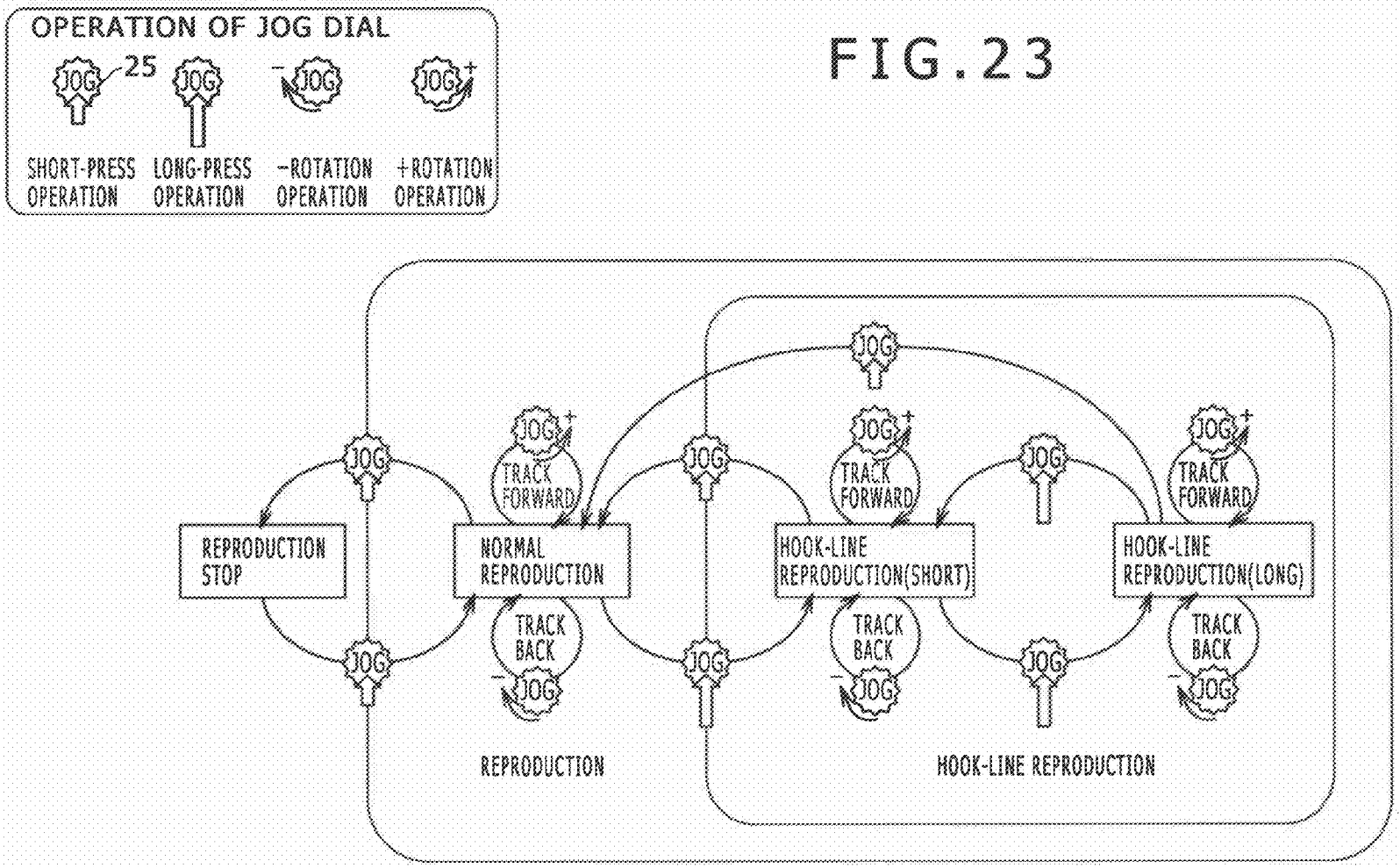
FIG. 23 is a schematic diagram for explaining operation of the headphone-integrated reproducing apparatus and reproduction control.

A detailed description will be made below about the operation of the jog dial 25 of the headphone-integrated reproducing apparatus 1 and the reproduction control with use of FIG. 23. The description will deal with the reproduction control in the state in which the reproduction order of plural music data is set to the specified reproduction order, as one example.

As described above, the headphone-integrated reproducing apparatus 1 allows input of plural kinds of commands by various kinds of operation of the jog dial 25 (short-press operation, long-press operation, + rotation operation, and – rotation operation).

The CPU 40 in the headphone-integrated reproducing apparatus 1 carries out reproduction control of music data in response to the operation of the jog dial 25.

In practice, for example, if short-press operation of the jog dial 25 is carried out in the state in which no music data is reproduced (i.e. in the reproduction stopped state), the CPU 40 shifts (changes over) to the normal reproduction mode, in which normal reproduction of music data is performed.

Upon shifting to the normal reproduction mode, the CPU 40 sequentially performs normal reproduction from e.g. the beginning music data based on the order specifying list stored in the ROM 41.

If + rotation operation of the jog dial 25 is carried out in this normal reproduction mode, the CPU 40 stops the normal reproduction of the currently-reproduced music data and performs normal reproduction of the next music data from its beginning position, based on the order specifying list. That is, the CPU 40 performs track forwarding to the beginning position of the next track (music data) in response to the + rotation operation of the jog dial 25.

Furthermore, if – rotation operation of the jog dial 25 is carried out in the normal reproduction mode, the CPU 40 performs track backing dependent on the reproducing position of the currently-reproduced music data.

Specifically, if the reproducing position of the music data at the timing when the – rotation operation of the jog dial 25 is carried out falls within the range of a predetermined time (e.g. four seconds) from the beginning position, the CPU 40 stops the reproduction of this music data and performs normal reproduction of the previous music data from its beginning position. That is, the CPU 40 performs track backing to the beginning position of the previous track.

In contrast, if the reproducing position of the music data at the timing when the – rotation operation of the jog dial 25 is carried out is out of the range of the predetermined time (e.g. four seconds) from the beginning position, the CPU 40 stops the reproduction of this music data and performs normal reproduction of this music data again from its beginning position. That is, the CPU 40 performs track backing to the beginning position of the currently-reproduced track.

In this manner, in response to the – rotation operation of the jog dial 25, the CPU 40 performs the track backing to the beginning position of the previous track or the beginning position of the currently-reproduced track.

Furthermore, if short-press operation of the jog dial 25 is carried out in the normal reproduction mode, the CPU 40 stops the reproduction of the music data and enters the reproduction stopped state.

If long-press operation of the jog dial 25 is carried out in the normal reproduction mode, the CPU 40 shifts to the hook-line reproduction mode in which the hook-line part of music data is reproduced.

As this hook-line reproduction mode, there are two modes of a hook-line reproduction (short) mode in which the hook-line reproducing time is short and a hook-line reproduction (long) mode in which the hook-line reproducing time is long. The following description is based on the assumption that the hook-line reproducing time in the hook-line reproduction (short) mode is set to e.g. four seconds and the hook-line reproducing time in the hook-line reproduction (long) mode is set to e.g. 15 seconds.

In practice, if long-press operation of the jog dial 25 is carried out in the normal reproduction mode, the CPU 40 shifts to the hook-line reproduction (short) mode of two hook-line reproduction modes.

Upon shifting from the normal reproduction mode to the hook-line reproduction (short) mode, the CPU 40 stops the normal reproduction of the currently-reproduced music data and performs hook-line reproduction of the music data next to this music data from its hook-line start position, based on the order specifying list. From then on, the CPU 40 performs hook-line reproduction of music data in turn based on the order specifying list. The hook-line reproducing time at this time is four seconds as described above.

Furthermore, at this time (i.e. at the time of the shift from the normal reproduction mode to the hook-line reproduction (short) mode), the CPU 40 reproduces guide data for notifying the user of the shift to the hook-line reproduction (short) mode. The guide data reproduced at this time is e.g. audio data obtained by recording an audio guide indicating the shift to the hook-line reproduction (short) mode. By reproducing such guide data, the CPU 40 allows the user to recognize the shift to the hook-line reproduction (short) mode by only audio.

If + rotation operation of the jog dial 25 is carried out in this hook-line reproduction (short) mode, the CPU 40 stops the hook-line reproduction of the currently-reproduced music data and performs hook-line reproduction of the next music data from its hook-line start position, based on the order specifying list. That is, the CPU 40 performs track forwarding to the hook-line start position of the next track (music data) in response to the + rotation operation of the jog dial 25.

If – rotation operation of the jog dial 25 is carried out in this hook-line reproduction (short) mode, the CPU 40 stops the hook-line reproduction of the currently-reproduced music data and performs hook-line reproduction of the previous music data from its hook-line start position. That is, the CPU 40 performs track backing to the hook-line start position of the previous track (music data) in response to the – rotation operation of the jog dial 25.

If short-press operation of the jog dial 25 is carried out in the hook-line reproduction (short) mode, the CPU 40 shifts to the normal reproduction mode.

Upon shifting from the hook-line reproduction (short) mode to the normal reproduction mode, the CPU 40 stops the hook-line reproduction of the currently-reproduced music data and performs normal reproduction of this music data again from its beginning position. From then on, the CPU 40 performs normal reproduction of music data in turn based on the order specifying list.

Furthermore, at this time (i.e. at the time of the shift from the hook-line reproduction (short) mode to the normal reproduction mode), the CPU 40 reproduces guide data for notifying the user of the shift to the normal reproduction mode. The guide data reproduced at this time is e.g. audio data obtained by recording an audio guide indicating the shift to the normal reproduction mode. By reproducing such guide data, the CPU 40 allows the user to recognize the shift to the normal reproduction mode by audio.

As above, the CPU 40 shifts to the hook-line reproduction (short) mode if long-press operation of the jog dial 25 is carried out in the normal reproduction mode. From then on, the CPU 40 reproduces the hook-line part in turn from the music data next to the music data lastly reproduced in the normal reproduction mode.

In this manner, the CPU 40 can switch the reproduction mode from the normal reproduction mode to the hook-line reproduction (short) mode by simple operation of merely carrying out long-press operation of the jog dial 25.

In the hook-line reproduction (short) mode, the CPU 40 reproduces the hook-line part of music data in turn to thereby allow the user to search for the desired track (music data) by only the audio of the hook-line part.

If short-press operation of the jog dial 25 is carried out during the reproduction of the hook-line part of music data, the CPU 40 shifts to the normal reproduction mode. Thereupon, the CPU 40 performs normal reproduction of the music data whose hook-line part is currently reproduced, from its beginning position.

Thus, the CPU 40 allows the user who has found the desired track (music data) in the hook-line reproduction (short) mode to immediately listen to the whole of this track (music data).

If long-press operation of the jog dial 25 is carried out in the hook-line reproduction (short) mode, the CPU 40 shifts to the hook-line reproduction (long) mode.

Upon shifting from the hook-line reproduction (short) mode to the hook-line reproduction (long) mode, the CPU 40 extends the hook-line reproducing time of the music data whose hook-line is currently reproduced. Specifically, the CPU 40 extends the time from four seconds to 15 seconds. For the music data reproduced at this time, hook-line reproduction is continued for 15 seconds from the timing of the shift to the hook-line reproduction (long) mode. From then on, the CPU 40 performs hook-line reproduction of music data in turn based on the order specifying list. The hook-line reproducing time at this time is 15 seconds as described above.

Furthermore, at this time (i.e. at the time of the shift from the hook-line reproduction (short) mode to the hook-line reproduction (long) mode), the CPU 40 reproduces guide data for notifying the user of the shift to the hook-line reproduction (long) mode. The guide data reproduced at this time is e.g. audio data obtained by recording an audio guide indicating the shift to the hook-line reproduction (long) mode in the hook-line reproduction mode. By reproducing such guide data, the CPU 40 allows the user to recognize the shift to the hook-line reproduction (long) mode in the hook-line reproduction mode by audio.

If + rotation operation of the jog dial 25 is carried out in this hook-line reproduction (long) mode, the CPU 40 stops the hook-line reproduction of the currently-reproduced music data and performs hook-line reproduction of the next music data from its hook-line start position, based on the order specifying list. That is, the CPU 40 performs track forwarding to the hook-line start position of the next track (music data) in response to the + rotation operation of the jog dial 25.

If – rotation operation of the jog dial 25 is carried out in this hook-line reproduction (long) mode, the CPU 40 stops the hook-line reproduction of the currently-reproduced music data and performs hook-line reproduction of the previous music data from its hook-line start position. That is, the CPU 40 performs track backing to the hook-line start position of the previous track (music data) in response to the – rotation operation of the jog dial 25.

If long-press operation of the jog dial 25 is carried out in the hook-line reproduction (long) mode, the CPU 40 shifts to the hook-line reproduction (short) mode.

Upon shifting from the hook-line reproduction (long) mode to the hook-line reproduction (short) mode, the CPU 40 shortens the reproducing time of the music data whose hook-line is currently reproduced. Specifically, the CPU 40 shortens the time from 15 seconds to four seconds. For the music data reproduced at this time, hook-line reproduction is continued for four seconds from the timing of the shift to the hook-line reproduction (short) mode. From then on, the CPU 40 performs hook-line reproduction of music data in turn based on the order specifying list. The hook-line reproducing time at this time is four seconds as described above.

Furthermore, at this time (i.e. at the time of the shift from the hook-line reproduction (long) mode to the hook-line reproduction (short) mode), the CPU 40 reproduces guide data for notifying the user of the shift to the hook-line reproduction (short) mode. The guide data reproduced at this time is e.g. audio data obtained by recording an audio guide indicating the shift to the hook-line reproduction (short) mode in the hook-line reproduction mode. By reproducing such guide data, the CPU 40 allows the user to recognize the shift to the hook-line reproduction (short) mode in the hook-line reproduction mode by audio.

If short-press operation of the jog dial 25 is carried out in the hook-line reproduction (long) mode, the CPU 40 shifts to the normal reproduction mode.

Upon shifting from the hook-line reproduction (long) mode to the normal reproduction mode, the CPU 40 stops the hook-line reproduction of the currently-reproduced music data and performs normal reproduction of this music data again from its beginning position. From then on, the CPU 40 performs normal reproduction of music data in turn based on the order specifying list.

Furthermore, at this time (i.e. at the time of the shift from the hook-line reproduction (long) mode to the normal reproduction mode), the CPU 40 reproduces guide data for notifying the user of the shift to the normal reproduction mode. The guide data reproduced at this time is e.g. the same audio data as that reproduced at the time of the shift from the hook-line reproduction (short) mode to the normal reproduction mode. By reproducing such guide data, the CPU 40 allows the user to recognize the shift to the normal reproduction mode by audio.

As above, if long-press operation of the jog dial 25 is carried out in the hook-line reproduction (short) mode, in which the hook-line reproducing time is as short as four seconds, the CPU 40 shifts to the hook-line reproduction (long) mode, in which the hook-line reproducing time is as long as 15 seconds. Furthermore, if the long-press operation is carried out in the hook-line reproduction (long) mode, the CPU 40 shifts to the hook-line reproduction (short) mode.

In this manner, the CPU 40 can switch the hook-line reproducing time in the hook-line reproduction mode from four seconds to 15 seconds or vice versa by simple operation of merely carrying out long-press operation of the jog dial 25.

This allows the CPU 40 to perform hook-line reproduction with the hook-line reproducing time suitable for the user and thus enhance the easiness of the search for a track (music data) by the hook-line reproduction.

As described above, at the time of the shift of the reproduction mode, the CPU 40 reproduces guide data for notifying the user of the shift of the reproduction mode. In practice, at the time of the reproduction of this guide data, a period during which the reproduction of this guide data and the reproduction of music data overlap with each other exists. During this period, the CPU 40 performs mixing reproduction of the guide data and the music data.

At this time, the CPU 40 turns down the reproduction volume of the music data, of the guide data and the music data, to thereby prevent the audio by the guide data from becoming hard to hear due to the music.

For example, assume that the reproduction mode is shifted from the normal reproduction mode to the hook-line reproduction (short) mode. At this time, the CPU 40 stops the normal reproduction of the currently-reproduced music data and performs hook-line reproduction of the music data next to this music data from its hook-line start position. In addition, the CPU 40 reproduces guide data for notifying the user of the shift to the hook-line reproduction (short) mode.

In this case, the period from the start of the reproduction of the guide data to the stop of the reproduction of the currently-reproduced music data and the period from the start of the reproduction of the next music data to the end of the reproduction of the guide data are the period during which mixing reproduction of the music data and the guide data is performed.

At this time, the CPU 40 stops the normal reproduction of the currently-reproduced music data in such a manner as to gradually turn down the reproduction volume of this music data from the current set value to 0 (i.e. execute fade-out processing). Furthermore, upon starting the reproduction of the next music data, the CPU 40 gradually turns up the reproduction volume of this music data from 0 to the current set value (i.e. executes fade-in processing).

In this manner, the CPU 40 executes fade-out/in processing for music data to thereby change the reproduction volume of the music data in the period during which mixing reproduction of the guide data and the music data is performed.

By this operation, the CPU 40 allows the user to hear the audio by the guide data more clearly.

Moreover, for example, assume that the reproduction mode is shifted from the hook-line reproduction (short) mode to the hook-line reproduction (long) mode. At this time, the CPU 40 extends the hook-line reproducing time of the currently-reproduced music data and continues the reproduction. In addition, the CPU 40 reproduces guide data for notifying the user of the shift to the hook-line reproduction (long) mode.

In this case, the period during which the guide data is reproduced is the period during which mixing reproduction of the music data and the guide data is performed.

At this time, the CPU 40 gradually turns down the reproduction volume of the music data whose hook-line is currently reproduced from the current set value to e.g. a value smaller by several tens of percentage (i.e. executes fade-out processing). After the elapse of a predetermined period, the CPU 40 gradually turns up the reproduction volume to the current set value again (i.e. executes fade-in processing). The period during which the reproduction volume of the music data whose hook-line is currently reproduced is suppressed is set substantially equal to the reproducing time of the guide data.

In this manner, the CPU 40 turns down the reproduction volume of music data in the period during which mixing reproduction of the guide data and the music data is performed. By this operation, the CPU 40 allows the user to hear the audio by the guide data more clearly while continuing the hook-line reproduction of the music data.

Moreover, also at the time of the shift from the hook-line reproduction mode to the normal reproduction mode and at the time of the shift from the hook-line reproduction (long) mode to the hook-line reproduction (short) mode, the CPU 40 similarly turns down the reproduction volume of music data in the period during which mixing reproduction of the guide data and the music data is performed.

In addition, not only at the time of the shift of the reproduction mode but also at the timing of switch of music data in the hook-line reproduction mode, the CPU 40 reproduces guide data for notifying the user of the switch of music data. The "timing of switch of music data" refers to the timing when track forwarding operation (+ rotation operation) is carried out, the timing when track backing operation (– rotation operation) is carried out, and the timing of switch to the hook-line reproduce of the next music data due to the elapse of the hook-line reproducing time.

The guide data reproduced at this time is sound effect data obtained by recording a sound effect indicating the switch of music data to the next music data or the previous music data. By reproducing such guide data, the CPU 40 allows the user to recognize the switch of the music data in the hook-line reproduction mode by the sound effect.

Also in this case, a period during which the reproduction of this guide data and the reproduction of music data overlap with each other exists. During this period, the CPU 40 performs mixing reproduction of the guide data and the music data.

Also at this time, the CPU 40 turns down the reproduction volume of the music data, of the guide data and the music data, to thereby prevent the sound effect by the guide data from becoming hard to hear due to the music.

For example, assume that track forwarding operation is carried out. At this time, the CPU 40 stops the hook-line reproduction of the currently-reproduced music data and performs hook-line reproduction of the next music data from its hook-line start position. In addition, the CPU 40 reproduces guide data for notifying the user of the switch of the music data.

In this case, the period from the start of the reproduction of the guide data to the stop of the hook-line reproduction of the currently-reproduced music data and the period from the start of the hook-line reproduction of the next music data to the end of the reproduction of the guide data are the period during which mixing reproduction of the music data and the guide data is performed.

At this time, the CPU 40 stops the hook-line reproduction of the currently-reproduced music data in such a manner as to gradually turn down the reproduction volume of this music data from the current set value to 0 (i.e. execute fade-out processing). Furthermore, upon starting the hook-line reproduction of the next music data, the CPU 40 gradually turns up the reproduction volume of this music data from 0 to the current set value (i.e. executes fade-in processing).

By this operation, the CPU 40 allows the user to hear the sound effect by the guide data more clearly.

Moreover, also at the time when track backing operation is carried out and at the time of the switch to hook-line reproduction of the next music data due to the elapse of the hook-line reproducing time, the CPU 40 similarly turns down the reproduction volume of music data in the period during which mixing reproduction of the guide data and the music data is performed.

As described above, the headphone-integrated reproducing apparatus 1 allows input of plural commands such as switch of the reproduction mode, reproduction start, reproduction stop, track forwarding, and track backing merely through operation of the jog dial 25.

Furthermore, the headphone-integrated reproducing apparatus 1 reproduces the hook-line part of music data in turn in the hook-line reproduction mode to thereby allow the user to easily search for the desired music data among plural music data although the headphone-integrated reproducing apparatus 1 does not have a display part for displaying information (track name or the like) relating to the music data.

In addition, at the time of switch (shift) of the reproduction mode and at the time of switch of the reproduced music data, the headphone-integrated reproducing apparatus 1 reproduces guide data for notification of this shift to thereby allow the user to easily recognize this shift.

Consequently, although having no display part, the headphone-integrated reproducing apparatus 1 can achieve usability equal to or higher than that of reproducing apparatus having a display part.

By the way, the headphone-integrated reproducing apparatus 1 (FIG. 22) is provided with the detector 33 that detects whether or not the right case 2 and the left case 3 are connected to each other based on change in the intensity (i.e. the magnetic flux density) of the applied magnetic field as described above.

Figure 24:
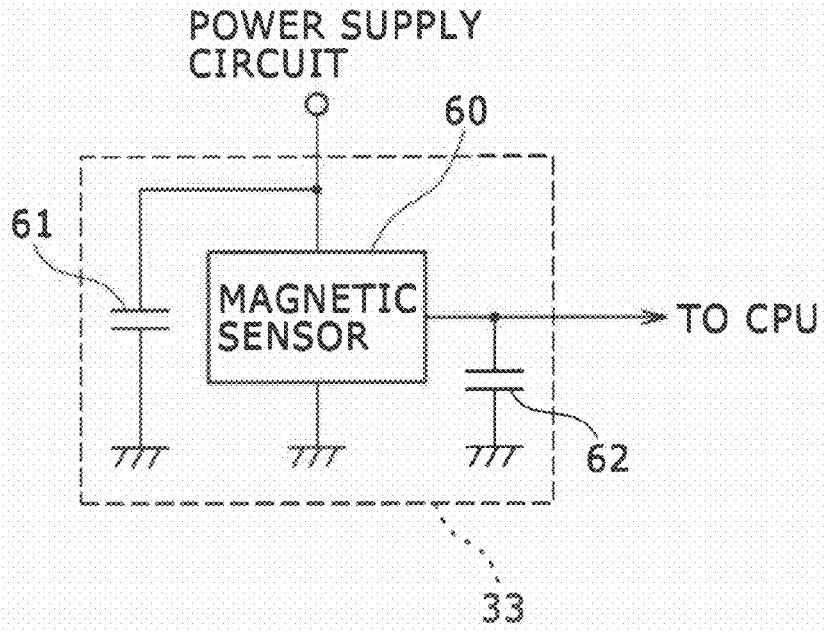
FIG. 24 is a block diagram showing the circuit configuration of the detector.

As shown in FIG. 24, the detector 33 has a magnetic sensor 60 as described above, and this magnetic sensor 60 is provided with a power supply terminal, an output terminal, and a ground terminal.

For the magnetic sensor 60, the power supply terminal is connected to a power supply terminal of the power supply circuit in the CPU 40, and the output terminal is connected to an input terminal (universal port) of the CPU 40 and the ground terminal is grounded.

For the detector 33, the connecting node between the power supply terminal of the magnetic sensor 60 and the power supply terminal of the power supply circuit is grounded via a first capacitor 61, and the connecting node between the output terminal of the magnetic sensor 60 and the input terminal of the CPU 40 is grounded via a second capacitor 62.

Figure 25:
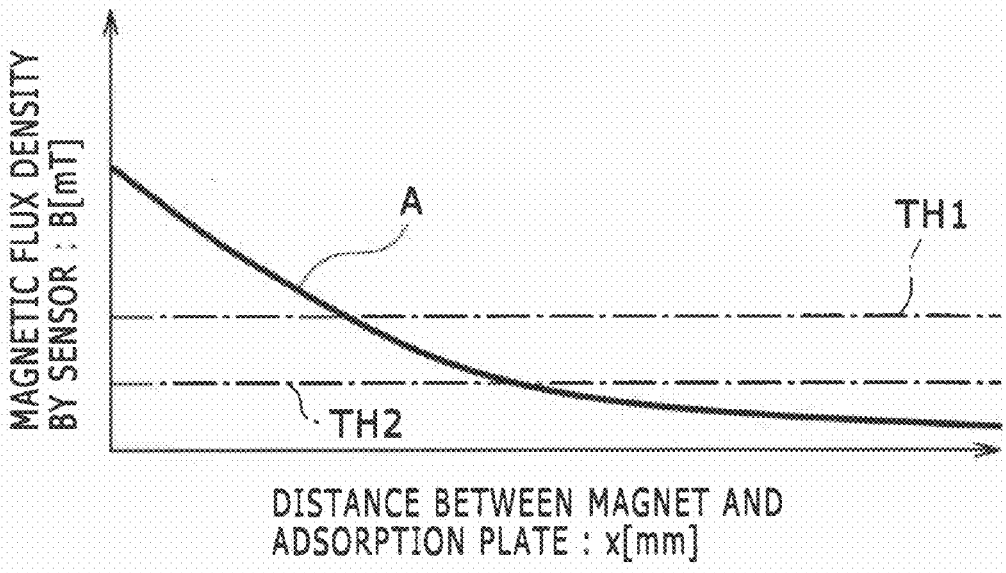
FIG. 25 is a schematic diagram for explaining detection as to whether or not the right case and the left case are connected to each other by a magnetic sensor of the detector.

As shown in FIG. 25, the detector 33 detects, by the magnetic sensor 60, the intensity of the applied magnetic field (i.e. the applied magnetic field by the magnet 30) changing depending on the distance between the right case 2 and the left case 3 (i.e. the distance between the detector 33 and the magnet 30) as the value of the magnetic flux density.

In this case, as is apparent also from characteristic curve A shown in FIG. 25, the magnetic flux density detected by the magnetic sensor 60 becomes higher as the distance between the right case 2 and the left case 3 decreases, and is the highest when the right case 2 and the left case 3 are connected to each other via the adsorption plate 20 and the magnet 30. On the other hand, the magnetic flux density detected by the magnetic sensor 60 becomes lower as the distance between the right case 2 and the left case 3 increases.

Therefore, a first threshold TH1 arbitrarily selected in order to detect whether or not the right case 2 and the left case 3 are connected to each other and a second threshold TH2 lower than the first threshold TH1 are set for the magnetic sensor 60 in the detector 33.

For example, when the CPU 40 enters the power-on state and is supplied with power from the power supply circuit to start the operation, the magnetic sensor 60 in the detector 33 compares the value of the magnetic flux density detected at the timing of the operation start with the first and second thresholds TH1 and TH2.

As a result, if the value of the magnetic flux density is equal to or higher than the first threshold TH1, then the magnetic sensor 60 sends out, to the CPU 40, a connection-detected signal at the logic "L" level indicating the state in which the right case 2 and the left case 3 are connected to each other.

In contrast, if the value of the magnetic flux density detected at the timing of the operation start is equal to or lower than the second threshold TH2, then the magnetic sensor 60 sends out, to the CPU 40, a separation-detected signal at the logic "H" level indicating the state in which the right case 2 and the left case 2 are separated from each other.

During the operation, the magnetic sensor 60 always detects the magnetic flux density and compares the value of the detected magnetic flux density with the first and second thresholds TH1 and TH2.

Once the magnetic sensor 60 detects magnetic flux density equal to or higher than the first threshold TH1 and sends out the connection-detected signal to the CPU 40, the magnetic sensor 60 continues to send out the connection-detected signal to the CPU 40 until it detects magnetic flux density equal to or lower than the second threshold TH2.

If the magnetic sensor 60 detects magnetic flux density equal to or lower than the second threshold TH2 while sending out the connection-detected signal to the CPU 40, the magnetic sensor 60 sends out the separation-detected signal to the CPU 40 instead of the connection-detected signal at this timing.

Once the magnetic sensor 60 detects magnetic flux density equal to or lower than the second threshold TH2 and sends out the separation-detected signal to the CPU 40, the magnetic sensor 60 continues to send out the separation-detected signal to the CPU 40 until it detects magnetic flux density equal to or higher than the first threshold TH1.

If the magnetic sensor 60 detects magnetic flux density equal to or higher than the first threshold TH1 while sending out the separation-detected signal to the CPU 40, the magnetic sensor 60 sends out the connection-detected signal to the CPU 40 instead of the separation-detected signal at this timing.

In this manner, by the magnetic sensor 60, the detector 33 can detect whether or not the right case 2 and the left case 3 are connected to each other and can notify the CPU 40 of the detection result by the connection-detected signal and the separation-detected signal.

In the following description, the connection-detected signal and the separation-detected signal will be referred to also as the connection-presence/absence-detected signal collectively if there is no particular need to distinguish between them.

On the other hand, if the connection-presence/absence-detected signal is supplied from the detector 33 to the CPU 40, the CPU 40 carries out various kinds of control depending on the supplied connection-presence/absence-detected signal.

Figures 26A, 26B, 26C, 26D, 26E, 26F:
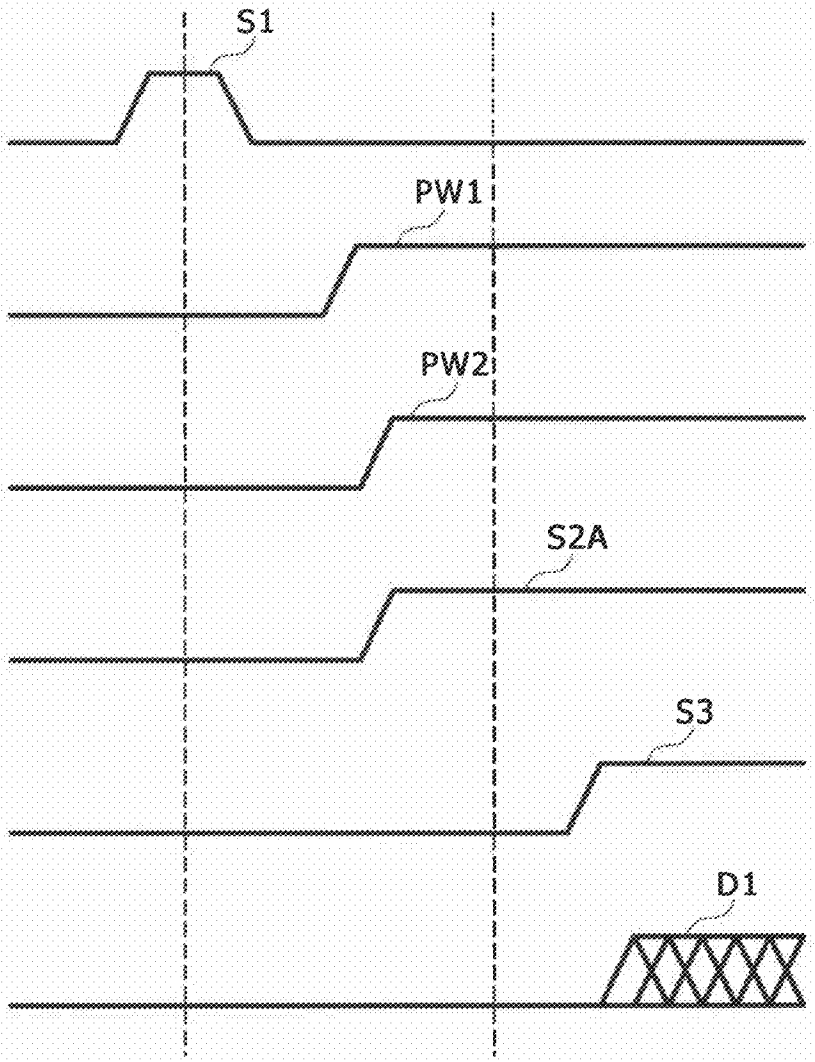
FIGS. 26A to 26F are timing charts for explaining control by a CPU in the state in which the right case and the left case are separated from each other.

As shown in FIGS. 26A to 26F, if short-press operation of the jog dial 25 is carried out in the state in which the right case 2 and the left case 3 are separated from each other, the CPU 40 captures an operation signal S1 that rises up to the logic "H" level only during the short-press operation from the jog dial 25 (FIG. 26A). At this time, the CPU 40 determines that a power-on command is input in response to the operation signal S1.

Upon determining that the power-on command is input, the CPU 40 captures supplied power PW1 from the battery 43 into the power supply circuit (FIG. 26B), and generates operating power PW2 based on the supplied power PW1 by the power supply circuit (FIG. 26C).

Thus, the CPU 40 enters the power-on state and starts the operation by the operating power PW2, and supplies each circuit block with the corresponding operating power PW2 to make the circuit blocks operate accordingly.

As a result, the separation between the right case 2 and the left case 3 is detected by the detector 33, which starts the operation at this time, and a separation-detected signal S2A is supplied therefrom (FIG. 26D). In response to the separation-detected signal S2A, the CPU 40 continues the control of the respective circuit blocks to make the circuit blocks operate accordingly.

If the CPU 40 is operating in the state in which the right case 2 and the left case 3 are separated from each other in this manner, the CPU 40 detects the remaining amount of the battery 43 via the power supply circuit for example.

Subsequently, the CPU 40 generates a light emission control signal S3 dependent on the detection result and sends out it to the remaining amount notifying light emitter 27, to thereby control the remaining amount notifying light emitter 27 based on the light emission control signal S3 to make the remaining amount notifying light emitter 27 emit light with the emission color dependent on the remaining amount of the battery 43 (FIG. 26E).

However, when the headphone-integrated reproducing apparatus 1 is mounted on the right auricle and the left auricle of the user, the right case inside surface 2A of the right case 2, on which the remaining amount notifying light emitter 27 is provided, is oriented toward the user's cheek, which precludes the user from directly viewing the remaining amount notifying light emitter 27.

Therefore, in the power-on state, the CPU 40 sequentially controls the remaining amount notifying light emitter 27 with a predetermined cycle (e.g. a cycle of 5 [sec]) to thereby make the remaining amount notifying light emitter 27 periodically blink with the emission color dependent on the remaining amount of the battery 43. Thus, the CPU 40 prevents the power of the battery 43 from being uselessly consumed due to the light emission of the remaining amount notifying light emitter 27.

Furthermore, for example, if short-press operation of the jog dial 25 is carried out in the power-on state in which the right case 2 and the left case 3 are kept separated from each other, the CPU 40 captures an operation signal that rises up to the logic "H" level only during the short-press operation from the jog dial 25. At this time, the CPU 40 determines that a command to start reproduction of music data D1 is input in response to the operation signal.

Upon determining that the reproduction start command is input, the CPU 40 reproduces the music data D1 as described above to thereby output stereo music based on the music data D1 from the right headphone 4 and the left headphone 5 and allow the user to listen to the stereo music (FIG. 26F).

By the way, as shown in FIGS. 27A to 27F, if the CPU 40 is in the power-on state in response to the input of the power-on command (FIG. 26A) with the right case 2 and the left case 3 separated from each other, the CPU 40 enables any operation of the operating unit 44 relating to the reproduction of the music data D1.

The state in which the operation of the operating unit 44 is enabled refers to the state in which the CPU 40 accepts input of an operation command (i.e. determines the input operation command) in response to the operation of the operating unit 44.

The operation relating to the reproduction of the music data D1 refers to short-press operation, long-press operation, + rotation operation, and – rotation operation of the jog dial 25 for start and stop of the reproduction of the music data D1, switch of the reproduction mode, track forwarding and track backing, and so on.

Furthermore, the operation relating to the reproduction of the music data D1 also refers to slide operation of the reproduction order changeover switch 26 for switching the reproduction order of the music data D1 and press-down operation of the volume adjustment key 24 for adjusting the volume.

Therefore, while the right case 2 and the left case 3 are separated from each other, the CPU 40 allows the user to input, by the operating unit 44, any of various operation commands relating to the reproduction of the music data D1, such as a reproduction start command, a reproduction stop command, and a reproduction order changeover command.

Figure 27A:
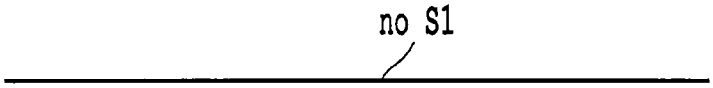
FIGS. 27A to 27F are timing charts for explaining control by the CPU when the right case and the left case are connected to each other during reproduction of music data.
Figure 27B:
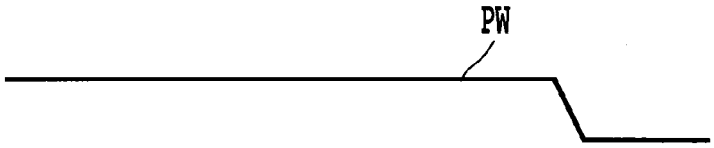
Figure 27C:
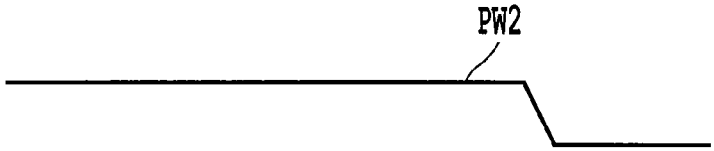
Figure 27D:
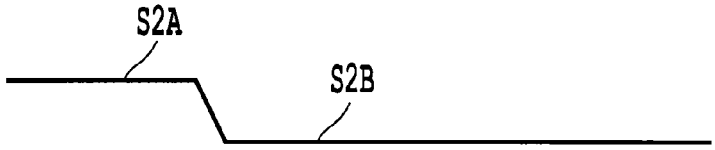
Figure 27E:
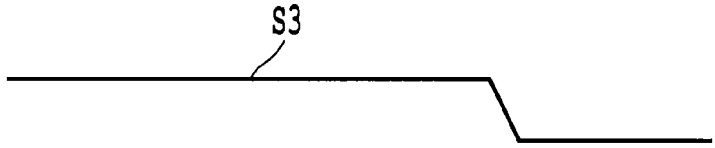
Figure 27F:
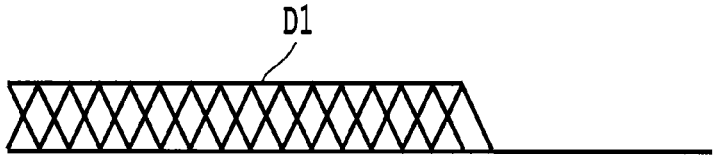

Thus, if the right case 2 and the left case 3 are separated from each other, the CPU 40 can perform the above-described normal reproduction and hook-line reproduction of the music data D1 (FIG. 27F).

In the following description, the normal reproduction and the hook-line reproduction of the music data D1 will be referred to also simply as the reproduction collectively if there is no particular need to distinguish between them.

Specifically, if the right case 2 and the left case 3 are separated from each other, the CPU 40 controls the respective circuit blocks in response to the operation of the operating unit 44 to thereby allow the headphone-integrated reproducing apparatus 1 to be freely used for normal reproduction and hook-line reproduction of music.

During the reproduction of the music data D1, the CPU 40 controls the remaining amount notifying light emitter 27 based on the light emission control signal S3 to make the remaining amount notifying light emitter 27 emit light with the emission color dependent on the remaining amount of the battery 43 similarly to the above description (FIG. 27E).

If, in this state, connection of the right case 2 and the left case 3 is detected by the detector 33 and a connection-detected signal S2B is supplied therefrom to the CPU 40 instead of the separation-detected signal S2A (FIG. 27D), the CPU 40 forcibly stops the reproduction of the currently-reproduced music data D1 (FIG. 27F).

In addition, upon forcibly stopping the reproduction of the music data D1, continuously the CPU 40 stops the sending of the light emission control signal S3 to the remaining amount notifying light emitter 27 to stop also the light emission (FIG. 27E).

However, in some cases, when the connection of the right case 2 and the left case 3 is detected, the headphone-integrated reproducing apparatus 1 has been removed from the right auricle and the left auricle as shown in FIGS. 14 and 15, and the right case 2 and the left case 3 have been connected to each other with the remaining amount notifying light emitter 27 oriented toward the user's face.

Thus, if the connection of the right case 2 and the left case 3 is detected, the CPU 40 ignores the cycle of the sending of the light emission control signal S3 to the remaining amount notifying light emitter 27 and sends out the light emission control signal S3 to the remaining amount notifying light emitter 27 immediately after forcibly stopping the reproduction of the music data D1.

Thus, when the connection of the right case 2 and the left case 3 is detected, the CPU 40 ignores the predetermined light emission cycle obeyed until this timing, and stops the light emission after making the remaining amount notifying light emitter 27 emit light one time finally (i.e. for a short time such as several seconds) based on the light emission control signal S3.

Therefore, when the right case 2 and the left case 3 are connected to each other with the remaining amount notifying light emitter 27 oriented toward the face by the user, the CPU 40 can allow the user to substantially surely check the remaining amount of the battery 43 through notification of the remaining amount by the remaining amount notifying light emitter 27.

Upon stopping the light emission of the remaining amount notifying light emitter 27, continuously the CPU 40 controls the power supply circuit to stop the generation of the operating power PW2 and stop also the supply of the operating power PW2 to the respective circuit blocks for stopping the operation of the circuit blocks (FIG. 27C).

In addition, upon stopping the operation of the respective circuit blocks, continuously the CPU 40 also stops the capturing of the supplied power PW1 from the battery 43 to stop its own operation and shift to the power-off state (FIG. 27B).

In this manner, if the connection of the right case 2 and the left case 3 is detected when the headphone-integrated reproducing apparatus 1 is being used for listening to music, the CPU 40 considers that the use of the headphone-integrated reproducing apparatus 1 is ended in response to the detection, and enters the power-off state.

When the connection of the right case 2 and the left case 3 is detected, the CPU 40 generates a light emission control signal in response to the detection and sends out the generated light emission control signal to the status notifying light emitter 28.

Thus, for example, the CPU 40 makes the status notifying light emitter 28 emit white light only one time (i.e. only for a short time such as several seconds) based on the light emission control signal, and thus notifies the user of the shift to the power-off state by the light emission of the status notifying light emitter 28.

Moreover, as shown in FIGS. 28A to 28F, if the CPU 40 is in the power-on state in response to the input of the power-on command (FIG. 26A) with the right case 2 and the left case 3 separated from each other as described above, the CPU 40 enables any operation of the operating unit 44.

Figure 28A:
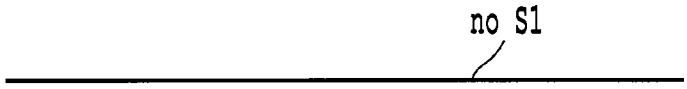
FIGS. 28A to 28F are timing charts for explaining control by the CPU when the right case and the left case are connected to each other in the state in which music data is not reproduced.
Figure 28B:
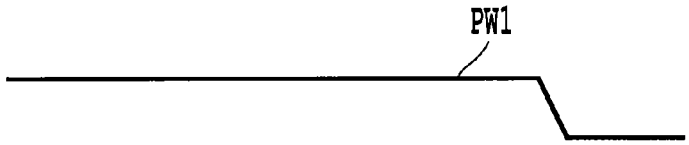
Figure 28C:
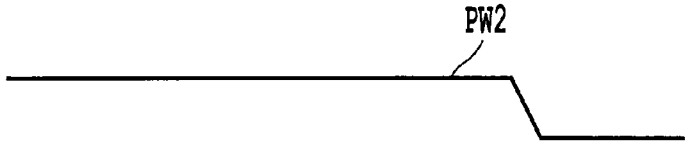
Figure 28D:
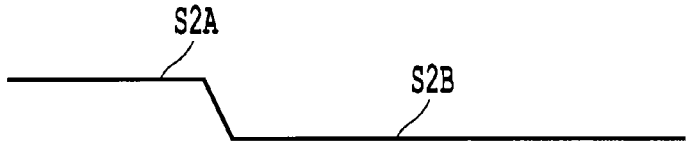
Figure 28E:
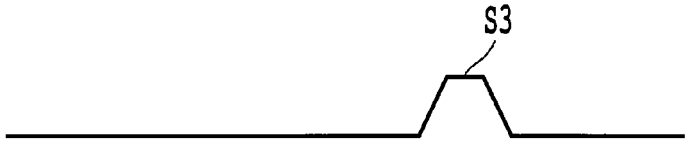
Figure 28F:
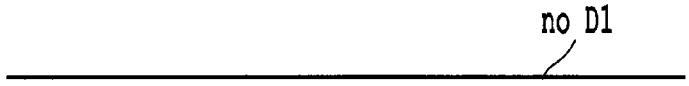

However, if operation relating to the reproduction of the music data D1 is not carried out at all in this state, the CPU 40 does not execute reproduction processing of the music data D1 (FIG. 28F) and also does not control the remaining amount notifying light emitter 27 at all to thereby keep its light emission stopped (FIG. 28E).

If, in this state, connection of the right case 2 and the left case 3 is detected by the detector 33 and the connection-detected signal S2B is supplied therefrom to the CPU 40 instead of the separation-detected signal S2A (FIG. 28D), the CPU 40 generates the light emission control signal S3 dependent on the remaining amount of the battery 43 at the timing.

By sending out the light emission control signal S3 to the remaining amount notifying light emitter 27, the CPU 40 makes the remaining amount notifying light emitter 27 emit light one time (i.e. for a short time such as several seconds) with the emission color dependent on the remaining amount of the battery 43 based on the light emission control signal S3, and then stops the light emission.

Therefore, if the right case 2 and the left case 3 are connected to each other with the remaining amount notifying light emitter 27 oriented toward the face by the user at the time, the CPU 40 can allow the user to substantially surely check the remaining amount of the battery 43 through notification of the remaining amount by the remaining amount notifying light emitter 27.

Upon stopping the light emission of the remaining amount notifying light emitter 27, continuously the CPU 40 controls the power supply circuit to stop the generation of the operating power PW2 and stop also the supply of the operating power PW2 to the respective circuit blocks for stopping the operation of the circuit blocks (FIG. 28C).

In addition, upon stopping the operation of the respective circuit blocks, continuously the CPU 40 also stops the capturing of the supplied power PW1 from the battery 43 to stop its own operation and shift to the power-off state (FIG. 28B).

In this manner, even when the music data D1 is not reproduced in the power-on state, if the connection of the right case 2 and the left case 3 is detected, the CPU 40 considers that the use of the headphone-integrated reproducing apparatus 1 is ended in response to the detection, and enters the power-off state.

Also in this case, the CPU 40 makes the status notifying light emitter 28 emit light to notify the user of the shift to the power-off state similarly to the above description.

Figure 29A:
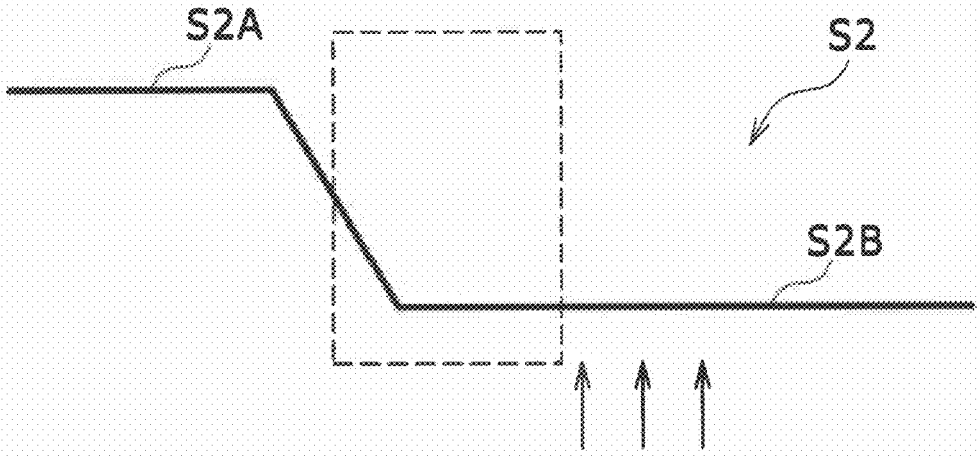
FIGS. 29A and 29B are schematic diagrams for explaining check of connection of the right case and the left case.
Figure 29B:
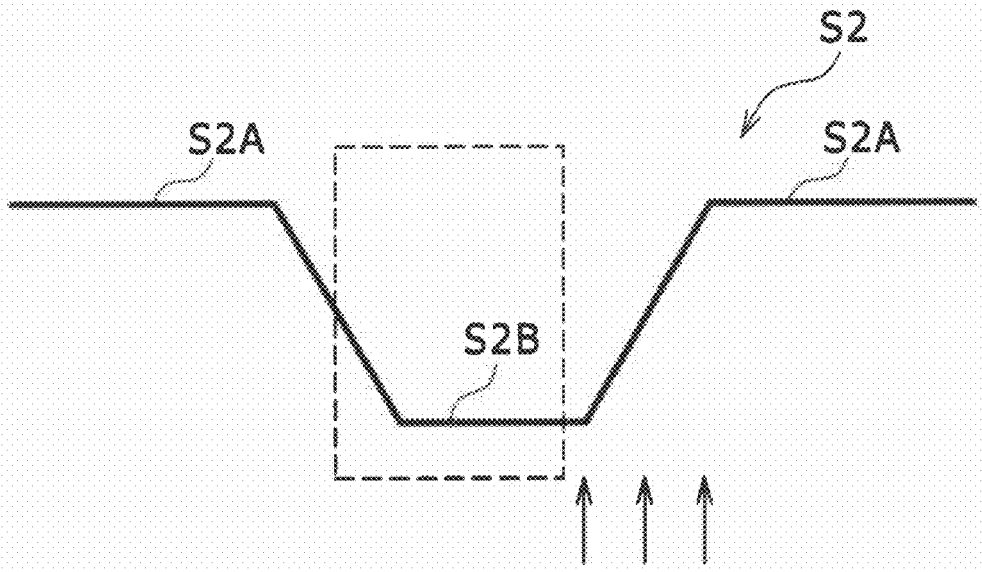

By the way, as shown in FIGS. 29A and 29B, the CPU 40 in the power-on state always monitors the level of the connection-presence/absence-detected signal S2 supplied from the detector 33.

In addition, the CPU 40 detects the falling of the level of the connection-presence/absence-detected signal S2 supplied from the detector 33 (i.e. switch from the separation-detected signal S2A to the connection-detected signal S2B).

When the falling of the level of the connection-presence/absence-detected signal S2 is detected by the CPU 40, the CPU 40 suspends execution of the control responding to the connection of the right case 2 and the left case 3 until a predetermined time (e.g. several hundred [msec]) selected in advance elapses from the timing of the detection of the level falling.

Upon the elapse of the predetermined time from the timing of the detection of the level falling, the CPU 40 detects the level of the connection-presence/absence-detected signal S2 several times (e.g. three times) with a predetermined cycle (e.g. a cycle of 100 [msec]).

As a result, if all of the levels detected several times for the connection-presence/absence-detected signal S2 are the same as the logic "L" level, the CPU 40 determines that the right case 2 and the left case 3 are connected to each other.

That is, the CPU 40 determines that the right case 2 and the left case 3 are connected to each other if the connection-detected signal S2B continues to be supplied from the detector 33 to the CPU 40 instead of the separation-detected signal S2A.

Upon determining that the right case 2 and the left case 3 are connected to each other, the CPU 40 stops the reproduction of the music data D1 and so on as described above and finally enters the power-off state, responding to the determination.

On the other hand, if all of the levels detected several times for the connection-presence/absence-detected signal S2 are not the same as the logic "L" level, the CPU 40 determines that the right case 2 and the left case 3 are not connected to each other.

That is, the CPU 40 determines that the right case 2 and the left case 3 are not connected to each other if the connection-detected signal S2B supplied from the detector 33 instead of the separation-detected signal S2A is replaced by the separation-detected signal S2A again.

Upon determining that the right case 2 and the left case 3 are not connected to each other, the CPU 40 keeps the power-on state to thereby continue also the currently-executed processing such as reproduction.

In this manner, the CPU 40 carries out stop of processing and control to the power-off state only when the right case 2 and the left case 3 are intentionally connected to each other by the user.

Specifically, when the right case 2 and the left case 3 are temporarily connected to each other erroneously by the user, the CPU 40 prevents music output from being forcibly stopped although the user does not want to stop the music and prevents the power supply from being turned off.

In particular, the detector 33 detects connection of the right case 2 and the left case 3 not only when the right case 2 and the left case 3 are completely connected to each other but also when they are brought somewhat close to each other (e.g. across a distance of several millimeters therebetween), depending on the position accuracy, detection accuracy, and so on of the magnetic sensor 60.

Therefore, also when the right case 2 and the left case 3 are temporarily brought close to each other erroneously by the user, the CPU 40 prevents music output from being forcibly stopped although the user does not want to stop the music and prevents the power supply from being turned off.

Figures 30A, 30B, 30C, 30D, 30E, 30F:
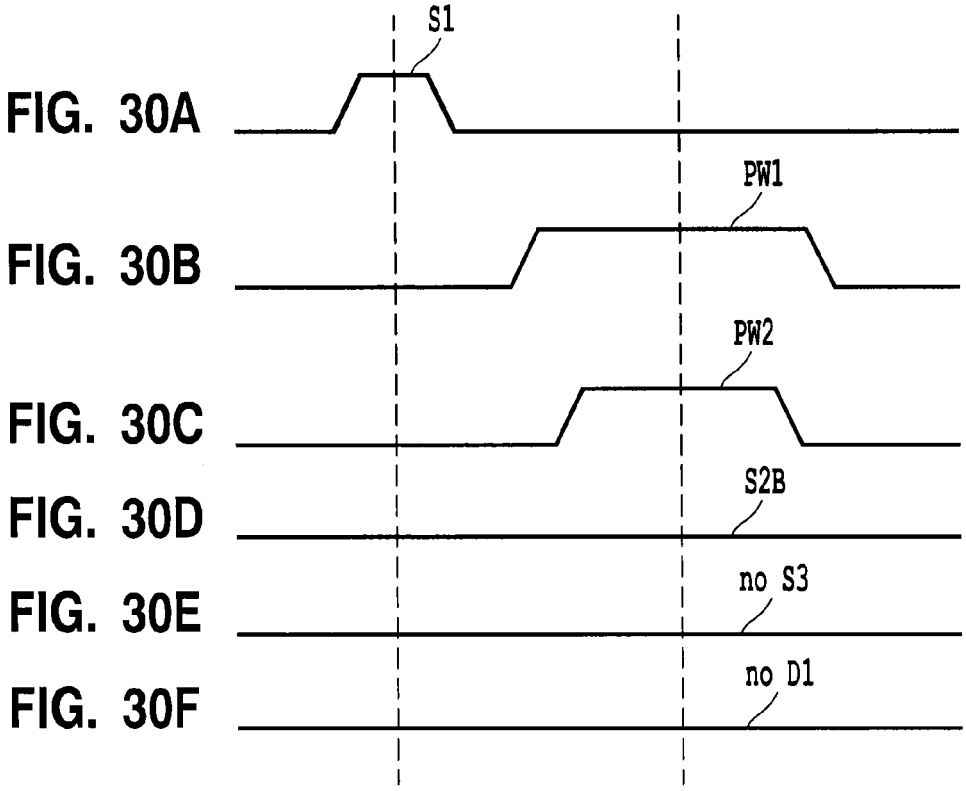
FIGS. 30A to 30F are timing charts for explaining control by the CPU when the right case and the left case are connected to each other.

As shown in FIGS. 30A to 30F, if short-press operation of the jog dial 25 is carried out in the state in which the right case 2 and the left case 3 are connected to each other, the CPU 40 captures the operation signal S1 supplied from the jog dial 25 in response to the short-press operation (FIG. 30A). At this time, the CPU 40 determines that a power-on command is input in response to the operation signal S1.

Upon determining that the power-on command is input, the CPU 40 captures the supplied power PW1 from the battery 43 into the power supply circuit (FIG. 30B), and generates the operating power PW2 based on the supplied power PW1 by the power supply circuit (FIG. 30C).

Thus, the CPU 40 enters the power-on state and starts the operation by the operating power PW2, and supplies each circuit block with the corresponding operating power PW2 to make the circuit blocks operate accordingly.

However, the connection between the right case 2 and the left case 3 is detected by the detector 33, which starts the operation at this time, and the connection-detected signal S2B is supplied therefrom to the CPU 40 (FIG. 30D). In response to the connection-detected signal S2B, the CPU 40 controls the power supply circuit to stop the generation of the operating power PW2.

In addition, the CPU 40 stops also the supply of the operating power PW2 to the respective circuit blocks to thereby stop the operation of the circuit blocks (FIG. 30C).

In addition, upon stopping the operation of the circuit blocks, continuously the CPU 40 also stops the capturing of the supplied power PW1 from the battery 43 to stop its own operation and return to the power-off state again (FIG. 30B).

If short-press operation of the jog dial 25 is carried out in the power-off state in which the right case 2 and the left case 3 are separated from each other, the headphone-integrated reproducing apparatus 1 regards this short-press operation as operation for input of a power-on command, and allows the operating unit 44 to accept operation relating to reproduction of the music data D1 after the short-press operation.

In contrast, if short-press operation of the jog dial 25 is carried out in the power-off state in which the right case 2 and the left case 3 are connected to each other, the CPU 40 shifts to the power-on state but immediately returns to the power-off state.

Therefore, while the right case 2 and the left case 3 are connected to each other, the CPU 40 carries out control in such a manner as to accept only short-press operation for input of a power-on command to the jog dial 25 and substantially disable all of the operation of the operating unit 44 relating to reproduction of the music data D1.

The state in which operation of the operating unit 44 relating to reproduction of the music data D1 is disabled refers to the state in which the CPU 40 does not accept input of an operation command responding to operation of the operating unit 44 relating to reproduction of the music data D1.

Due to this feature, for example even if the operating unit 44 is erroneously operated while the headphone-integrated reproducing apparatus 1 is carried with the right case 2 and the left case 3 connected to each other, the CPU 40 does not reproduce the music data D1 (FIG. 30F) and thus can prevent the power of the battery 43 from being uselessly consumed.

Furthermore, for example even if the operating unit 44 is erroneously operated while the headphone-integrated reproducing apparatus 1 is carried with the right case 2 and the left case 3 connected to each other, the CPU 40 also does not make the remaining amount notifying light emitter 27 emit light (FIG. 30E) and thus can prevent the power of the battery 43 from being uselessly consumed, more surely.

While the right case 2 and the left case 3 are connected to each other, the CPU 40 does not allow the light emission of the status notifying light emitter 28 and so on at all and causes no apparent change of the headphone-integrated reproducing apparatus 1, although temporarily entering the power-on state in response to short-press operation of the jog dial 25.

Thus, the CPU 40 makes the headphone-integrated reproducing apparatus 1 appear not to accept operation at all, including short-press operation for input of a power-on command, (i.e. appear to keep the operating unit 44 at the hold state) while the right case 2 and the left case 3 are connected to each other.

Therefore, when the operating unit 44 is operated by the user with the right case 2 and the left case 3 connected to each other, the CPU 40 can allow the user to easily recognize that setting is so made that this operation is disabled.

Thus, while the right case 2 and the left case 3 are connected to each other, the CPU 40 can also prevent the power of the battery 43 from being uselessly consumed e.g. due to alternate shift to the power-on state and the power-off state in response to many times of short-press operation of the jog dial 25 by the user.

[1-4 Procedure of Reproduction Control Processing]

Figure 31:
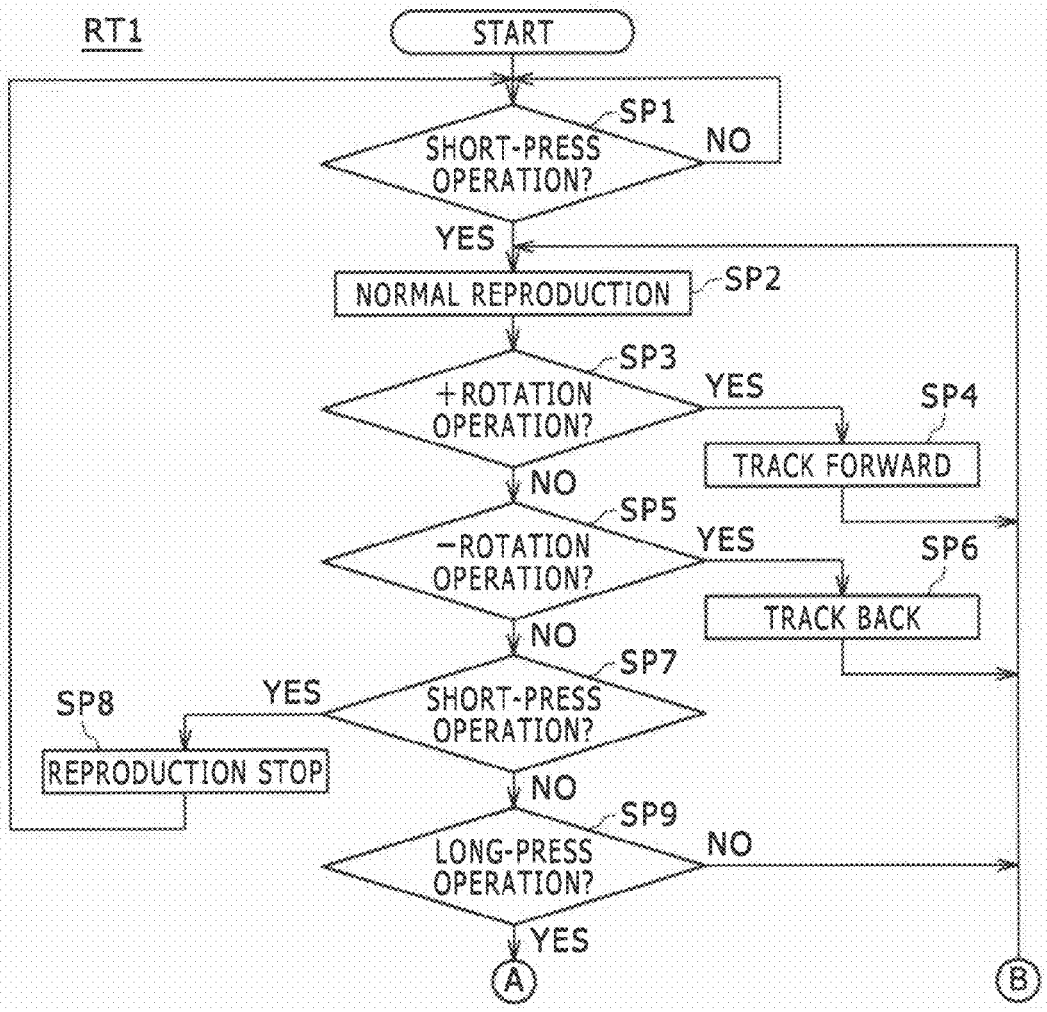
FIG. 31 is a flowchart showing the procedure of reproduction control processing.

With use of the flowcharts shown in FIG. 31 and FIG. 32, the procedure RT1 of processing of reproduction control by the above-described headphone-integrated reproducing apparatus 1 (it will be referred to also as the procedure of reproduction control processing) will be described below. This procedure RT1 of reproduction control processing is the procedure of processing executed by the CPU 40 in the headphone-integrated reproducing apparatus 1 in accordance with a program stored in the ROM 41.

Upon entering the power-on state, the CPU 40 in the headphone-integrated reproducing apparatus 1 starts this procedure RT1 of reproduction control processing and moves to a step SP1. In the step SP1, the CPU 40 waits until short-press operation of the jog dial 25 is carried out.

If short-press operation of the jog dial 25 is carried out, the CPU 40 obtains the positive result in this step SP1 and moves to a step SP2. In the step SP2, the CPU 40 shifts to the normal reproduction mode to start normal reproduction of music data, and thereafter moves to the next step SP3.

In the step SP3, the CPU 40 determines whether or not + rotation operation of the jog dial 25 is carried out. If + rotation operation of the jog dial 25 is carried out and thus the positive result is obtained in this step SP3, the CPU 40 moves to a step SP4.

In the step SP4, the CPU 40 stops reproduction of the currently-reproduced music data and starts reproduction of the next music data (i.e. performs track forwarding). Thereafter, the CPU 40 returns to the step SP2 again and continues the normal reproduction of music data.

In contrast, if + rotation operation of the jog dial 25 is not carried out and thus the negative result is obtained in the above-described step SP3, the CPU 40 moves to a step SP5.

In the step SP5, the CPU 40 determines whether or not – rotation operation of the jog dial 25 is carried out. If – rotation operation of the jog dial 25 is carried out and thus the positive result is obtained in this step SP5, the CPU 40 moves to a step SP6.

In the step SP6, the CPU 40 stops reproduction of the currently-reproduced music data and starts reproduction of the previous music data or starts reproduction of the currently-reproduced music data from its beginning position (i.e. performs track backing). Thereafter, the CPU 40 returns to the step SP2 again and continues the normal reproduction of music data.

In contrast, if the negative result is obtained in the above-described step SP5, then this means that neither + rotation operation nor – rotation operation of the jog dial 25 is carried out. In this case, the CPU 40 moves to a step SP7 and determines whether or not short-press operation of the jog dial 25 is carried out. If short-press operation of the jog dial 25 is carried out and thus the positive result is obtained in this step SP7, the CPU 40 moves to a step SP8.

In the step SP8, the CPU 40 stops reproduction of the currently-reproduced music data and returns to the step SP1 again, where the CPU 40 waits for short-press operation of the jog dial 25.

In contrast, if the negative result is obtained in the above-described step SP7, then this means that any of + rotation operation, – rotation operation, and short-press operation of the jog dial 25 is not carried out. In this case, the CPU 40 moves to a step SP9 and determines whether or not long-press operation of the jog dial 25 is carried out. If the negative result is obtained in this step SP9, then this means that any operation of the jog dial 25 is not carried out. In this case, the CPU 40 returns to the step SP2 again and continues the normal reproduction of music data.

Figure 32:
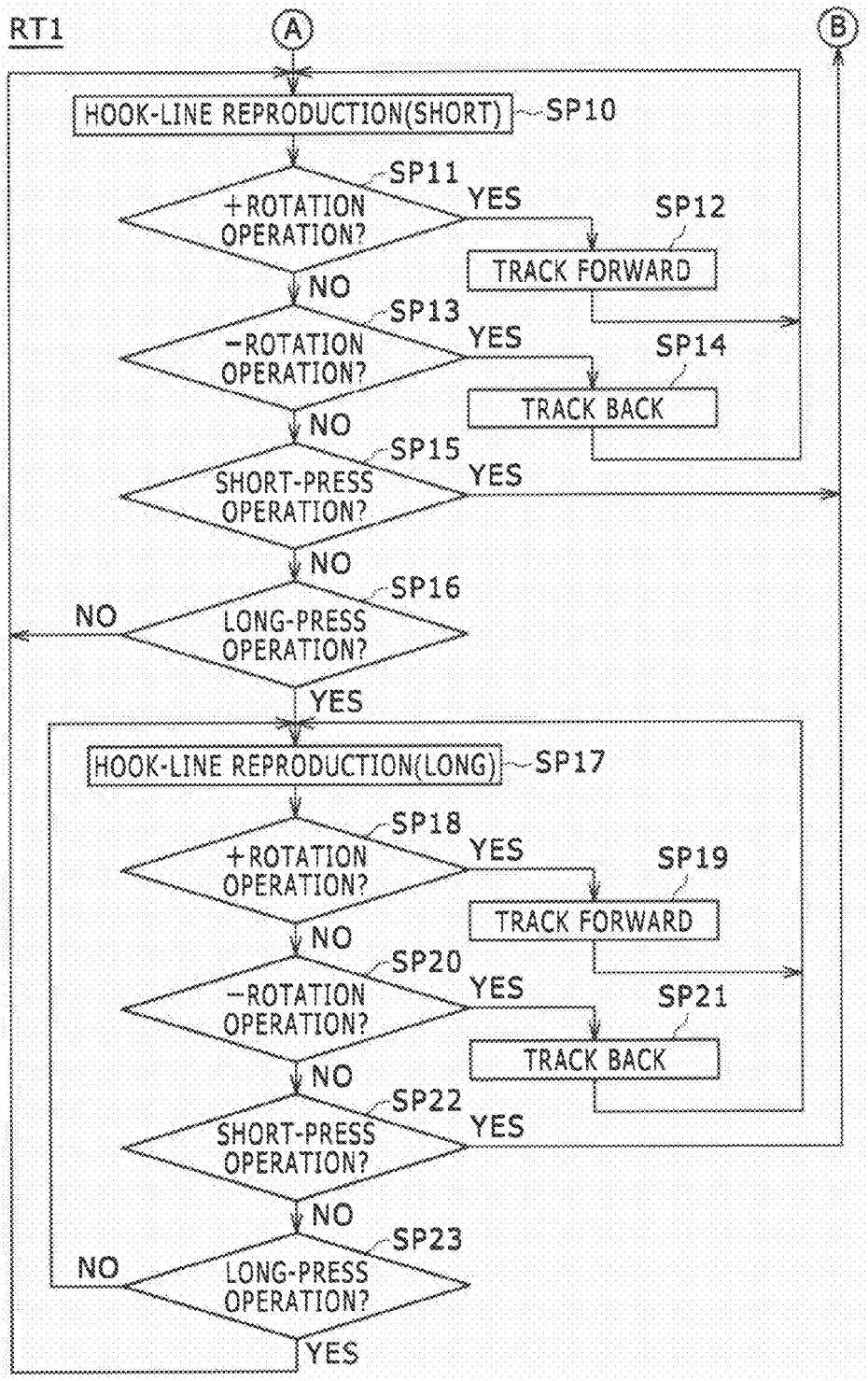
FIG. 32 is a flowchart following the flowchart of FIG. 31 showing the procedure of reproduction control processing.

In contrast, if long-press operation of the jog dial 25 is carried out and thus the positive result is obtained in the above-described step SP9, the CPU 40 moves to a step SP10 (FIG. 32).

In the step SP10, the CPU 40 shifts to the hook-line reproduction (short) mode. Furthermore, the CPU 40 stops reproduction of the currently-reproduced music data and starts hook-line reproduction of the next music data, and thereafter moves to the next step SP11.

In the step SP11, the CPU 40 determines whether or not + rotation operation of the jog dial 25 is carried out. If + rotation operation of the jog dial 25 is carried out and thus the positive result is obtained in this step SP11, the CPU 40 moves to a step SP12.

In the step SP12, the CPU 40 stops the hook-line reproduction of the currently-reproduced music data and starts hook-line reproduction of the next music data (i.e. performs track forwarding). Thereafter, the CPU 40 returns to the step SP10 again and continues the hook-line reproduction of music data.

In contrast, if + rotation operation of the jog dial 25 is not carried out and thus the negative result is obtained in the above-described step SP11, the CPU 40 moves to a step SP13.

In the step SP13, the CPU 40 determines whether or not – rotation operation of the jog dial 25 is carried out. If – rotation operation of the jog dial 25 is carried out and thus the positive result is obtained in this step SP13, the CPU 40 moves to a step SP14.

In the step SP14, the CPU 40 stops the hook-line reproduction of the currently-reproduced music data and starts hook-line reproduction of the previous music data (i.e. performs track backing). Thereafter, the CPU 40 returns to the step SP10 and continues the hook-line reproduction of music data.

In contrast, if the negative result is obtained in the above-described step SP13, then this means that neither + rotation operation nor – rotation operation of the jog dial 25 is carried out. In this case, the CPU 40 moves to a step SP15 and determines whether or not short-press operation of the jog dial 25 is carried out. If short-press operation of the jog dial 25 is carried out and thus the positive result is obtained in this step SP15, the CPU 40 returns to the step SP2 (FIG. 31) and shifts from the hook-line reproduction (short) mode to the normal reproduction mode. In this case, the CPU 40 stops the hook-line reproduction of the currently-reproduced music data and performs normal reproduction of this music data again from its beginning position.

In contrast, if the negative result is obtained in the above-described step SP15, then this means that any of + rotation operation, – rotation operation, and short-press operation of the jog dial 25 is not carried out. In this case, the CPU 40 moves to a step SP16 and determines whether or not long-press operation of the jog dial 25 is carried out. If the negative result is obtained in this step SP16, then this means that any operation of the jog dial 25 is not carried out. In this case, the CPU 40 returns to the step SP10 again and continues the hook-line reproduction of music data.

In contrast, if long-press operation of the jog dial 25 is carried out and thus the positive result is obtained in the above-described step SP16, the CPU 40 moves to a step SP17.

In the step S17, the CPU 40 shifts to the hook-line reproduction (long) mode and extends the reproducing time of the music data whose hook-line is currently played from four seconds to 15 seconds. Thereafter, the CPU 40 moves to the next step SP18.

In the step SP18, the CPU 40 determines whether or not + rotation operation of the jog dial 25 is carried out. If + rotation operation of the jog dial 25 is carried out and thus the positive result is obtained in this step SP18, the CPU 40 moves to a step SP19.

In the step SP19, the CPU 40 stops the hook-line reproduction of the currently-reproduced music data and starts hook-line reproduction of the next music data (i.e. performs track forwarding). Thereafter, the CPU 40 returns to the step SP17 again and continues the hook-line reproduction of music data.

In contrast, if + rotation operation of the jog dial 25 is not carried out and thus the negative result is obtained in the above-described step SP18, the CPU 40 moves to a step SP20.

In the step SP20, the CPU 40 determines whether or not – rotation operation of the jog dial 25 is carried out. If – rotation operation of the jog dial 25 is carried out and thus the positive result is obtained in this step SP20, the CPU 40 moves to a step SP21.

In the step SP21, the CPU 40 stops the hook-line reproduction of the currently-reproduced music data and starts hook-line reproduction of the previous music data (i.e. performs track backing). Thereafter, the CPU 40 returns to the step SP17 and continues the hook-line reproduction of music data.

In contrast, if the negative result is obtained in the above-described step SP20, then this means that neither + rotation operation nor – rotation operation of the jog dial 25 is carried out. In this case, the CPU 40 moves to a step SP22 and determines whether or not short-press operation of the jog dial 25 is carried out. If short-press operation of the jog dial 25 is carried out and thus the positive result is obtained in this step SP22, the CPU 40 returns to the step SP2 (FIG. 31) and shifts from the hook-line reproduction (long) mode to the normal reproduction mode. In this case, the CPU 40 stops the hook-line reproduction of the currently-reproduced music data and performs normal reproduction of this music data again from its beginning position.

In contrast, if the negative result is obtained in the above-described step SP22, then this means that any of + rotation operation, – rotation operation, and short-press operation of the jog dial 25 is not carried out. In this case, the CPU 40 moves to a step SP23 and determines whether or not long-press operation of the jog dial 25 is carried out. If the negative result is obtained in this step SP23, then this means that any operation of the jog dial 25 is not carried out. In this case, the CPU 40 returns to the step SP17 again and continues the hook-line reproduction of music data.

In contrast, if long-press operation of the jog dial 25 is carried out and thus the positive result is obtained in the above-described step SP23, the CPU 40 returns to the SP10, where the CPU 40 shifts from the hook-line reproduction (long) mode to the hook-line reproduction (short) mode and shortens the hook-line reproducing time from 15 seconds to four seconds.

In accordance with this procedure RT1 of reproduction control processing, the CPU 40 carries out reproduction control of music data in response to the operation of the jog dial 25.

[1-5 Operation and Advantageous Effects]

In the above-described configuration, the right headphone 4 of the canal type is so provided as to protrude on the right case inside surface 2A as one surface of the right case 2 of the headphone-integrated reproducing apparatus 1. Furthermore, the left headphone 5 of the canal type is so provided as to protrude on the left case inside surface 3A as one surface of the left case 3 of the headphone-integrated reproducing apparatus 1. Moreover, the jog dial 25 is provided on the right case lower surface 2D as another surface orthogonal to one surface of the right case 2 and near the base of the right headphone 4.

The right case 2 and the left case 3 of this headphone-integrated reproducing apparatus 1 are mounted around the head of the user through insertion of the right headphone 4 into the hole of the right ear and insertion of the left headphone 5 into the hole of the left ear.

At this time, the headphone-integrated reproducing apparatus 1 allows the user to, while sandwiching the side surfaces of the right case 2 by the thumb and another finger, operate by the thumb the jog dial 25 located at the part with which the belly of the thumb is in contact at the time.

Thus, the headphone-integrated reproducing apparatus 1 can prevent the shift of the mounting position of the right case 2 at the time of the operation of the jog dial 25 and allows the user to carry out various kinds of operation easily and surely by this jog dial 25.

This headphone-integrated reproducing apparatus 1 carries out reproduction control such as switch of the reproduction mode, reproduction start, reproduction stop, track forwarding, and track backing in response to various kinds of operation of the jog dial 25.

This headphone-integrated reproducing apparatus 1 has, as the reproduction mode, the normal reproduction mode in which the entire part of music data from the beginning position to the end position is sequentially reproduced, and the hook-line reproduction mode in which the hook-line part of music data is sequentially reproduced.

In this hook-line reproduction mode, the headphone-integrated reproducing apparatus 1 sequentially reproduces the hook-line part of music data to thereby allow the user to easily search for the desired music data among plural music data although the headphone-integrated reproducing apparatus 1 does not have a display part for displaying information relating to the music data.

In the above-described configuration, the right case 2 and the left case 3 of the headphone-integrated reproducing apparatus 1 are mounted around the head of the user through insertion of the right headphone 4 and the left headphone 5 into the holes of the right ear and the left ear. Moreover, the headphone-integrated reproducing apparatus 1 allows the user to operate the jog dial 25 by the thumb to thereby input plural commands, while sandwiching the side surfaces of the right case 2 by the thumb and another finger so that the shift of this mounting position may be prevented. This allows the headphone-integrated reproducing apparatus 1 to have further-enhanced operability compared with related arts.

<2. Other Embodiments>

[2-1 Another Embodiment 1]

In the above-described embodiment, if long-press operation of the jog dial 25 is carried out in the normal reproduction mode, the CPU 40 shifts to the hook-line reproduction (short) mode. In addition, if long-press operation of the jog dial 25 is carried out in this hook-line reproduction (short) mode, the CPU 40 shifts to the hook-line reproduction (long) mode.

However, the embodiment of the present invention is not limited thereto but the CPU 40 may shift to the hook-line reproduction (long) mode if long-press operation of the jog dial 25 is carried out in the normal reproduction mode.

Furthermore, at the time of the shift to the normal reproduction mode, the CPU 40 may store, in the ROM 41, information indicating which of the hook-line reproduction (short) mode and the hook-line reproduction (long) mode is the hook-line reproduction mode used before this shift (this information will be referred to also as previous hook-line reproduction mode information).

In this case, if long-press operation of the jog dial 25 is carried out in the normal reproduction mode, the CPU 40 shifts to the hook-line reproduction mode indicated by the previous hook-line reproduction mode information stored in the ROM 41.

Specifically, if the hook-line reproduction (short) mode is indicated in this previous hook-line reproduction mode information, the CPU 40 shifts from the normal reproduction mode to the hook-line reproduction (short) mode in response to the long-press operation of the jog dial 25. In contrast, if the hook-line reproduction (long) mode is indicated in this previous hook-line reproduction mode information, the CPU 40 shifts from the normal reproduction mode to the hook-line reproduction (long) mode in response to the long-press operation of the jog dial 25.

Thus, at the time of the shift from the normal reproduction mode to the hook-line reproduction mode, the CPU 40 can shift to, of the hook-line reproduction (short) mode and the hook-line reproduction (long) mode, the hook-line reproduction mode used by the user until immediately before the previous shift to the normal reproduction mode. In other words, at the time of the shift from the normal reproduction mode to the hook-line reproduction mode, the CPU 40 can set the reproducing time of the hook-line reproduction mode (four seconds or 15 seconds) to the hook-line reproducing time employed in the previous hook-line reproduction mode.

Thus, the headphone-integrated reproducing apparatus 1 allows immediate shift from the normal reproduction mode to, of the hook-line reproduction (short) mode and the hook-line reproduction (long) mode, the hook-line reproduction mode always used by the user, and thus allows further enhancement in the usability at the time of the mode switch.

In addition, when the CPU 40 enters the power-off state due to detection of connection of the right case 2 and the left case 3, the CPU 40 may store, in the ROM 41, information indicating which reproduction mode is employed until immediately before this power-off (this information will be referred to also as information on the reproduction mode at the time of the power-off).

In this case, if short-press operation of the jog dial 25 is carried out after separation of the right case 2 and the left case 3 is detected and the CPU 40 enters the power-on state, the CPU 40 shifts to the reproduction mode indicated by the information on the reproduction mode at the time of the power-off, stored in the ROM 41.

Specifically, if the normal reproduction mode is indicated in this information on the reproduction mode at the time of the power-off, the CPU 40 shifts to the normal reproduction mode in response to the short-press operation of the jog dial 25, and starts normal reproduction of music data. If the hook-line reproduction (short) mode is indicated in this information on the reproduction mode at the time of the power-off, the CPU 40 shifts to the hook-line reproduction (short) mode in response to the short-press operation of the jog dial 25, and starts hook-line reproduction of music data. If the hook-line reproduction (long) mode is indicated in this information on the reproduction mode at the time of the power-off, the CPU 40 shifts to the hook-line reproduction (long) mode in response to the short-press operation of the jog dial 25, and starts hook-line reproduction of music data.

Thus, at the time of the power-on, the CPU 40 can shift to the reproduction mode used by the user until immediately before the previous power-off.

[2-2 Another Embodiment 2]

In the above-described embodiment, the headphone-integrated reproducing apparatus 1 has two hook-line reproduction modes (the hook-line reproduction (short) mode and the hook-line reproduction (long) mode) having different hook-line reproducing times.

However, the embodiment of the present invention is not limited thereto but the headphone-integrated reproducing apparatus may have one hook-line reproduction mode whose hook-line reproducing time is a predetermined time or may have three or more hook-line reproduction modes having different hook-line reproducing times. If the headphone-integrated reproducing apparatus has three or more hook-line reproduction modes, the CPU 40 switches the hook-line reproduction mode in turn every time long-press operation of the jog dial 25 is carried out, for example.

It is also possible to employ a configuration in which the headphone-integrated reproducing apparatus has one hook-line reproduction mode and the hook-line reproducing time of this hook-line reproduction mode can be set to any time by the user.

Specifically, the CPU 40 shifts to the hook-line reproduction mode if long-press operation of the jog dial 25 is carried out in the normal reproduction mode. At this time, the CPU 40 employs the time period of the long-press operation as the hook-line reproducing time.

Specifically, when the user wants to employ a long time as the hook-line reproducing time of the hook-line reproduction mode, the user carries out the long-press operation of the jog dial 25 for a long time period. When the user wants to employ a short time as the hook-line reproducing time, the user carries out the long-press operation for a short time period.

Thus, in the headphone-integrated reproducing apparatus 1, the hook-line reproducing time in the hook-line reproduction mode can be freely changed by intuitive operation of changing the time period of long-press operation of the jog dial 25.

The time period of the long-press operation does not necessarily need to be matched with the hook-line reproducing time. For example, it is possible to employ a configuration in which the times that can be set as the hook-line reproducing time are "four seconds," "ten seconds," and "15 seconds" and the time periods of the long-press operation corresponding to these times are "equal to or longer than one second and shorter than two seconds," "equal to or longer than two seconds and shorter than three seconds," and "equal to or longer than three seconds," respectively.

In addition, while the long-press operation of the jog dial 25 is carried out, the CPU 40 may reproduce guide data for notifying the user of what time has elapsed since the start of the long-press operation at every predetermined interval, for example. The guide data reproduced at the time is e.g. sound effect data obtained by recording an effect that sounds like a blip.

Moreover, it is possible to employ a configuration in which the number of hook-line reproduction modes having different hook-line reproducing times is e.g. three and the reproduction mode shifts to the hook-line reproduction mode with the hook-line reproducing time corresponding to the time period of long-press operation of the jog dial 25.

[2-3 Another Embodiment 3]

In the above-described embodiment, the CPU 40 shifts to the hook-line reproduction (short) mode if long-press operation of the jog dial 25 is carried out in the normal reproduction mode.

However, the embodiment of the present invention is not limited thereto but the CPU 40 may shift to the hook-line reproduction (short) mode, instead of performing track forwarding, if + rotation operation of the jog dial 25 is carried out in the normal reproduction mode. In this case, the CPU 40 may enter the power-off state if long-press operation of the jog dial 25 is carried out in the normal reproduction mode.

Furthermore, the CPU 40 may shift to the hook-line reproduction (short) mode, instead of performing track backing, if − rotation operation of the jog dial 25 is carried out in the normal reproduction mode. In this case, the CPU 40 sequentially performs hook-line reproduction in the reverse order of the order specified by the order specifying list.

Other various kinds of association may be employed as the association between the operation of the jog dial 25 and the input command.

[2-4 Another Embodiment 4]

In the above-described embodiment, at the time of the shift of the reproduction mode, audio data obtained by recording an audio guide for this shift is reproduced as guide data for notification of this shift. However, the embodiment of the present invention is not limited thereto but audio data obtained by recording a sound effect indicating this shift may be reproduced.

Moreover, in the above-described embodiment, at the time of the switch of music data in the hook-line reproduction mode, audio data obtained by recording a sound effect indicating this switch is reproduced as guide data for notification of this switch. However, the embodiment of the present invention is not limited thereto but audio data obtained by recording an audio guide for this switch may be reproduced.

[2-5 Another Embodiment 5]

The above-described embodiment is an example of application to the headphone-integrated reproducing apparatus 1, in which headphones and a reproducing apparatus are integrated with each other.

However, the embodiment of the present invention is not limited thereto but may be applied to a wireless headphone apparatus that is obtained by removing the above-described reproduction control function from the above-described headphone-integrated reproducing apparatus 1 and can wirelessly communicate with an external reproducing apparatus having the above-described reproduction control function.

In this case, a wireless transmitter/receiver is provided in the wireless headphone apparatus, and the CPU 40 transmits a command signal input in response to operation of the jog dial 25 to the external reproducing apparatus via this transmitter/receiver.

As a result, the external reproducing apparatus that has received this command signal by its transmitter/receiver carries out reproduction control similar to that by the headphone-integrated reproducing apparatus 1. Subsequently, this reproducing apparatus transmits a music signal obtained by reproducing music data and an audio signal obtained by reproducing guide data to the wireless headphone apparatus via its transmitter/receiver.

This wireless headphone apparatus outputs music based on the received music signal and guide audio or a sound effect based on the received audio signal.

In this manner, the embodiment of the present invention can be applied also to a wireless headphone apparatus. This can enhance the operability of this wireless headphone apparatus similarly to the above-described headphone-integrated reproducing apparatus 1.

Furthermore, the embodiment of the present invention is not limited to the headphone-integrated reproducing apparatus 1 and the wireless headphone apparatus that have the right and left headphones as a stereo-type apparatus but can be applied also to a headphone-integrated reproducing apparatus and a wireless headphone apparatus that have only either one of the right and left headphones as a monaural-type apparatus.

[2-6 Another Embodiment 6]

In the above-described embodiment, the jog dial 25 is provided on the right case lower surface 2D as a side surface of the right case 2 and near the base of the right headphone 4 in the headphone-integrated reproducing apparatus 1.

However, the embodiment of the present invention is not limited thereto but the jog dial 25 may be provided e.g. on the right case upper surface 2C instead of on the right case lower surface 2D as long as it is on a side surface of the right case 2 and near the base of the right headphone 4. In this case, the jog dial 25 is located at the position of the belly of e.g. the index finger sandwiching the right case 2. That is, the jog dial 25 is operated by this index finger. In addition, this jog dial 25 may be provided on the left case 3 instead of on the right case 2.

Moreover, any of various operating devices other than the jog dial 25 may be provided in the headphone-integrated reproducing apparatus 1 as long as it is an operating device that allows input of plural commands through press-down operation and rotational operation.

[2-7 Another Embodiment 7]

In the above-described embodiment, the right headphone 4 and the left headphone 5 that are the canal type are provided in the headphone-integrated reproducing apparatus 1. However, the embodiment of the present invention is not limited thereto but a headphone other than the canal-type headphone may be provided as long as it is a type of headphone that is inserted into the ear hole.

[2-8 Another Embodiment 8]

In the above-described embodiment, the headphone-integrated reproducing apparatus 1 as the reproducing apparatus and the headphone apparatus has the right case 2 as the case. Furthermore, the right headphone 4 as the headphone inserted into the ear hole is provided on the right case 2 of this headphone-integrated reproducing apparatus 1. In addition, the jog dial 25 as the operating unit is provided on the right case 2 of this headphone-integrated reproducing apparatus 1. Moreover, the CPU 40 as the reproducing unit and the controller is provided in this headphone-integrated reproducing apparatus 1.

However, the embodiment of the present invention is not limited thereto but the above-described respective units of the headphone-integrated reproducing apparatus 1 may be configured by other various kinds of hardware or software as long as the same functions are possessed.

[2-9 Another Embodiment 9]

The present invention is not limited to the above-described Embodiment and Another Embodiment 1 to Another Embodiment 8 described up to here. Specifically, the application range of the present invention covers also forms obtained by arbitrarily combining a part or all of the above-described Embodiment and Another Embodiment 1 to Another Embodiment 8 described up to here and forms obtained by extracting a part of the above-described Embodiment and Another Embodiment 1 to Another Embodiment 8.

For example, Another Embodiment 1 and Another Embodiment 2 may be combined with each other. Specifically, at the time of the shift to the hook-line reproduction mode, the CPU 40 employs the time period of long-press operation of the jog dial 25 as the hook-line reproducing time. Furthermore, at the time of the shift to the normal reproduction mode, the CPU 40 stores, in the ROM 41, information indicating the hook-line reproducing time of the hook-line reproduction mode employed before this shift (this information will be referred to also as previous hook-line reproducing time information). Thereafter, at the time of the shift to the hook-line reproduction mode, the CPU 40 may employ the hook-line reproducing time indicated by the previous hook-line reproducing time information as the hook-line reproducing time of the hook-line reproduction mode.

Another Embodiment 1 and Another Embodiment 3 may be combined with each other. Specifically, the CPU 40 switches the reproduction mode from the normal reproduction mode to the hook-line reproduction mode in response to + rotation operation of the jog dial 25. In the shift from the normal reproduction mode to the hook-line reproduction mode, the CPU 40 may shift to the hook-line reproduction mode used until immediately before the previous shift to the normal reproduction mode.

The embodiments of the present invention can be widely used in a headphone apparatus having an operating unit.

The present application contains subject matter related to that disclosed in Japanese Priority Patent Application JP 2008-334942 filed in the Japan Patent Office on Dec. 26, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A reproducing apparatus comprising:

a case;

a headphone configured to protrude on one surface of the case and be inserted into an ear hole;

an operating unit provided on a further surface orthogonal to the one surface of the case and near a base of the headphone, the operating unit being configured to receive press-down operation and rotational operation;

a reproducing unit configured to reproduce audio data; and a controller incorporated in the case and configured to cause the reproducing unit to reproduce audio data stored in a storage medium based on an operation input received by the operating unit, wherein, the controller causes the reproducing unit to switch between a normal reproduction mode in which all of a plurality of audio data are reproduced in turn and a characteristic part reproduction mode in which only characteristic parts of the plurality of audio data are reproduced in turn, based on the operation received by the operating unit, the characteristic part is a hook-line part, the hook-line part being a part of the audio data corresponding to a specific frequency band of the audio data, the characteristic part reproduction mode is a hook-line reproduction mode in which only hook-line parts of the audio data are reproduced in turn, the controller switches a reproduction mode from the normal reproduction mode to the hook-line reproduction mode when long-press operation of pressing the operating unit for a long time is received in the normal reproduction mode, and the controller switches the reproduction mode from the hook-line reproduction mode to the normal reproduction mode when short-press operation of pressing the operating unit for a short time is received in the hook-line reproduction mode, and in switching from the normal reproduction mode to the hook-line reproduction mode, the controller changes a hook-line part reproducing time in the hook-line reproduction mode based on a time period of long-press operation of the operating unit.

2. The reproducing apparatus according to claim 1, wherein the operating unit is located on the further surface as a lower surface of the case when the headphone is inserted into an ear hole.

3. The reproducing apparatus according to claim 1, wherein in switch of the reproduction mode, the controller makes the reproducing unit reproduce audio guide data for notifying a user of the reproduction mode.

4. The reproducing apparatus of claim 3, wherein the reproduction of the audio guide data overlaps the reproduction of the audio data during the switch from the normal reproduction mode to the characteristic part reproduction mode.

5. The reproducing apparatus of claim 4, wherein the controller gradually reduces a reproduction volume of the audio data during a start of the reproduction of the audio guide data and gradually increases the reproduction volume of the audio data toward an end of the reproduction of the audio guide data.

6. The reproducing apparatus of claim 5, wherein a reproduction time of the audio guide data is predetermined.

7. A reproducing apparatus comprising:

a case;

a headphone configured to protrude on one surface of the case and be inserted into an ear hole;

an operating unit provided on a further surface orthogonal to the one surface of the case and near a base of the headphone, the operating unit being configured to receive press-down operation and rotational operation;

a reproducing unit configured to reproduce audio data; and a controller incorporated in the case and configured to cause the reproducing unit to reproduce audio data stored in a storage medium on an operation received by the operating unit, wherein, the controller causes the reproducing unit to switch between a normal reproduction mode in which all of a plurality of audio data are reproduced in turn and a characteristic part reproduction mode in which only characteristic parts of the plurality of audio data are reproduced in turn, based on the operation received by the operating unit, the characteristic part is a hook-line part, the hook-line part being a part of the audio data corresponding to a specific frequency band of the audio data, the characteristic part reproduction mode is a hook-line reproduction mode in which only hook-line parts of the audio data are reproduced in turn, the controller switches a reproduction mode from the normal reproduction mode to the hook-line reproduction mode when long-press operation of pressing the operating unit for a long time is received in the normal reproduction mode, and the controller switches the reproduction mode from the hook-line reproduction mode to the normal reproduction mode when short-press operation of pressing the operating unit for a short time is received in the hook-line reproduction mode, and in the hook-line reproduction mode, the controller changes a hook-line part reproducing time every time long-press operation of pressing the operating unit for a long time is input.

8. The reproducing apparatus according to claim 7, wherein in switch from the normal reproduction mode to the hook-line reproduction mode, the controller sets a hook-line part reproducing time to a hook-line part reproducing time employed in a previous hook-line reproduction mode.

9. A headphone apparatus comprising:

a first case including:

a first headphone configured to protrude from a first surface of the first case; and an adsorption plate disposed on a first end of the first case;

a second case including:

a second headphone configured to protrude from a second surface of the second case; and a housing to receive the adsorption plate and disposed on a second end of the second case to allow attachment of the first case to the second case; and an operating unit provided on a further surface orthogonal to the first surface of the first case and near a base of the first headphone, the operating unit being configured to receive press-down operation and rotational operation.

10. The reproducing apparatus of claim 9, further comprising:

a magnet disposed on a back side of a bottom plate of the housing disposed on the second end of the second case.

11. The reproducing apparatus of claim 9, further comprising:

a reproduction order changeover switch disposed on the first surface of the first case.

12. The reproducing apparatus of claim 9, further comprising a detector that detects a change in a magnetic field based on a distance between the first case and the second case.

13. The reproducing apparatus of claim 12, wherein the detector comprises a magnetic sensor that detects whether or not the first case and the second case are connected to each other.

14. The reproducing apparatus of claim 12, wherein when the detector detects that the first case and the second case are attached, the controller stops the reproduction of the audio data.

15. The reproducing apparatus of claim 12, further comprising a light emitter that displays a light color based on a remaining amount of battery.

16. The reproducing apparatus of claim 15, wherein when the detector detects that the first case and the second case are attached, the controller stops the display of the light color.

* * * * *